US009784070B2

(12) United States Patent
Neer

(10) Patent No.: US 9,784,070 B2
(45) Date of Patent: Oct. 10, 2017

(54) SYSTEM AND METHOD FOR SERVICING A WELLBORE

(75) Inventor: Adam Kent Neer, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 81 days.

(21) Appl. No.: 13/538,911

(22) Filed: Jun. 29, 2012

(65) Prior Publication Data

US 2014/0000909 A1 Jan. 2, 2014

(51) Int. Cl.

| | |
|---|---|
| ***E21B 34/14*** | (2006.01) |
| ***E21B 34/06*** | (2006.01) |
| ***E21B 34/10*** | (2006.01) |
| *E21B 34/00* | (2006.01) |

(52) U.S. Cl.
CPC ..... *E21B 34/108* (2013.01); *E21B 34/14* (2013.01); *E21B 2034/007* (2013.01)

(58) Field of Classification Search
USPC ..... 166/373, 66.6, 318, 334.1
See application file for complete search history.

(56) References Cited

U.S. PATENT DOCUMENTS

| | | | |
|---|---|---|---|
| 2,201,290 | A | 5/1940 | Greene |
| 2,493,650 | A | 1/1950 | Baker et al. |
| 2,537,066 | A | 1/1951 | Lewis |
| 2,627,314 | A | 2/1953 | Baker et al. |
| 2,913,051 | A | 11/1959 | Lister |
| 3,054,415 | A | 9/1962 | Baker et al. |
| 3,057,405 | A | 10/1962 | Mallinger |
| 3,151,681 | A | 10/1964 | Cochran |
| 3,216,497 | A | 11/1965 | Howard et al. |
| 3,295,607 | A | 1/1967 | Sutliff |
| 3,363,696 | A | 1/1968 | Berryman |
| 3,434,537 | A | 3/1969 | Zandmer |

(Continued)

FOREIGN PATENT DOCUMENTS

| | | |
|---|---|---|
| AU | 2012200380 A1 | 2/2012 |
| CA | 2778311 A1 | 5/2011 |

(Continued)

OTHER PUBLICATIONS

Encyclopedia entry for "RFID", accessed Jul. 28, 2014 via thefreedictionary.com.*

(Continued)

*Primary Examiner* — Blake Michener
(74) *Attorney, Agent, or Firm* — John W. Wustenberg; Baker Botts L.L.P.

(57) ABSTRACT

A wellbore servicing tool comprising a housing at least partially defining an axial flowbore, the housing comprising one or more ports, a sliding sleeve, and a fluid delay system. The sliding sleeve is slidably positioned within the housing and transitionable from a first position in which the sliding prevents fluid communication via a route of fluid communication via the one or more ports to a second position in which the sliding sleeve allows fluid communication via the route of fluid communication via the one or more ports. The fluid delay system is configured to retain the sliding sleeve in the first position until actuated and to allow the sliding sleeve to transition from the first position to the second position at a controlled rate when actuated. The fluid delay system is actuatable via a wireless signal.

19 Claims, 8 Drawing Sheets

(56) References Cited

U.S. PATENT DOCUMENTS 3,662,825 A 5/1972 Nutter
3,662,826 A 5/1972 Young et al.
3,768,556 A 10/1973 Baker
3,850,238 A 11/1974 Hill
4,047,564 A 9/1977 Nix et al.
4,081,990 A 4/1978 Chatagnier
4,105,069 A 8/1978 Baker
4,109,725 A 8/1978 Williamson et al.
4,150,994 A 4/1979 Maternaghan
4,196,782 A 4/1980 Blanton
4,373,582 A 2/1983 Bednar et al.
4,417,622 A 11/1983 Hyde
4,469,136 A 9/1984 Watkins
4,605,074 A 8/1986 Barfield
4,673,039 A 6/1987 Mohaupt
4,691,779 A 9/1987 McMahan et al.
4,714,117 A 12/1987 Dech
4,771,831 A 9/1988 Pringle et al.
4,842,062 A 6/1989 Schneider et al.
4,893,678 A 1/1990 Stokley et al.
5,125,582 A 6/1992 Surjaatmadja et al.
5,127,472 A 7/1992 Watson et al.
5,137,086 A 8/1992 Stokley et al.
5,156,220 A 10/1992 Forehand et al.
5,180,016 A 1/1993 Ross et al.
5,193,621 A 3/1993 Manke et al.
5,289,875 A 3/1994 Stokley et al.
5,314,032 A 5/1994 Pringle et al.
5,323,856 A 6/1994 Davis et al.
5,325,917 A 7/1994 Szarka
5,325,923 A 7/1994 Surjaatmadja et al.
5,361,856 A 11/1994 Surjaatmadja et al.
5,366,015 A 11/1994 Surjaatmadja et al.
5,375,662 A 12/1994 Echols, III et al.
5,381,862 A 1/1995 Szarka et al.
5,396,957 A 3/1995 Surjaatmadja et al.
5,425,424 A 6/1995 Reinhardt et al.
5,484,016 A 1/1996 Surjaatmadja et al.
5,494,103 A 2/1996 Surjaatmadja et al.
5,494,107 A 2/1996 Bode
5,499,678 A 3/1996 Surjaatmadja et al.
5,499,687 A 3/1996 Lee
5,533,571 A 7/1996 Surjaatmadja et al.
5,558,153 A 9/1996 Holcombe et al.
5,732,776 A 3/1998 Tubel et al.
5,765,642 A 6/1998 Surjaatmadja
5,826,661 A 10/1998 Parker et al.
5,865,252 A 2/1999 Van Petegem et al.
5,865,254 A 2/1999 Huber et al.
5,927,401 A 7/1999 Morris et al.
5,944,105 A 8/1999 Nguyen
5,947,198 A 9/1999 McKee et al.
5,947,205 A 9/1999 Shy
5,960,881 A 10/1999 Allamon et al.
6,000,468 A 12/1999 Pringle
6,003,834 A 12/1999 Read
6,006,838 A 12/1999 Whiteley et al.
6,041,864 A * 3/2000 Patel et al. ..... 166/332.4
6,116,343 A 9/2000 Van Petegem et al.
6,119,783 A 9/2000 Parker et al.
6,145,593 A 11/2000 Hennig
6,152,232 A 11/2000 Webb et al.
6,167,974 B1 1/2001 Webb
6,189,618 B1 2/2001 Beeman et al.
6,216,785 B1 4/2001 Achee, Jr. et al.
6,230,811 B1 5/2001 Ringgenberg et al.
6,241,015 B1 6/2001 Pringle et al.
6,244,342 B1 6/2001 Sullaway et al.
6,253,861 B1 7/2001 Carmichael et al.
6,257,339 B1 7/2001 Haugen et al.
6,286,599 B1 9/2001 Surjaatmadja et al.
6,318,469 B1 11/2001 Patel
6,318,470 B1 11/2001 Chang et al.
6,336,502 B1 1/2002 Surjaatmadja et al.
6,343,658 B2 2/2002 Webb
6,359,569 B2 * 3/2002 Beck et al. ..... 340/856.3
6,422,317 B1 7/2002 Williamson, Jr.
6,453,997 B1 9/2002 McNeilly et al.
6,467,541 B1 10/2002 Wells
6,494,264 B2 12/2002 Pringle et al.
6,520,257 B2 2/2003 Allamon et al.
6,543,538 B2 4/2003 Tolman et al.
6,561,277 B2 5/2003 Algeroy et al.
6,571,875 B2 6/2003 Bissonnette et al.
6,634,428 B2 10/2003 Krauss et al.
6,662,874 B2 12/2003 Surjaatmadja et al.
6,662,877 B2 12/2003 Patel
6,712,160 B1 3/2004 Schultz et al.
6,719,054 B2 4/2004 Cheng et al.
6,722,427 B2 4/2004 Gano et al.
6,725,933 B2 4/2004 Middaugh et al.
6,769,490 B2 8/2004 Allamon et al.
6,776,238 B2 8/2004 Dusterhoft et al.
6,779,607 B2 8/2004 Middaugh et al.
6,787,758 B2 9/2004 Tubel et al.
6,789,619 B2 9/2004 Carlson et al.
6,802,374 B2 10/2004 Edgar et al.
6,907,936 B2 6/2005 Fehr et al.
6,923,255 B2 8/2005 Lee
6,938,690 B2 9/2005 Surjaatmadja
6,997,252 B2 2/2006 Porter et al.
6,997,263 B2 2/2006 Campbell et al.
7,013,971 B2 3/2006 Griffith et al.
7,021,384 B2 4/2006 Themig
7,021,389 B2 4/2006 Bishop et al.
7,055,598 B2 6/2006 Ross et al.
7,066,265 B2 6/2006 Surjaatmadja
7,090,153 B2 8/2006 King et al.
7,096,954 B2 8/2006 Weng et al.
7,108,067 B2 9/2006 Themig et al.
7,134,505 B2 11/2006 Fehr et al.
7,159,660 B2 1/2007 Justus
7,168,493 B2 1/2007 Eddison
7,195,067 B2 3/2007 Manke et al.
7,219,730 B2 5/2007 Tilton et al.
7,225,869 B2 6/2007 Willett et al.
7,228,908 B2 6/2007 East, Jr. et al.
7,234,529 B2 6/2007 Surjaatmadja
7,237,612 B2 7/2007 Surjaatmadja et al.
7,243,723 B2 7/2007 Surjaatmadja et al.
7,252,147 B2 8/2007 Badalamenti et al.
7,252,152 B2 * 8/2007 LoGiudice et al. ..... 166/386
7,273,099 B2 9/2007 East, Jr. et al.
7,278,486 B2 10/2007 Alba et al.
7,287,592 B2 10/2007 Surjaatmadja et al.
7,290,611 B2 11/2007 Badalamenti et al.
7,296,625 B2 11/2007 East, Jr.
7,303,008 B2 12/2007 Badalamenti et al.
7,306,043 B2 12/2007 Toekje et al.
7,322,412 B2 1/2008 Badalamenti et al.
7,322,417 B2 1/2008 Rytlewski et al.
7,325,617 B2 2/2008 Murray
7,337,844 B2 3/2008 Surjaatmadja et al.
7,337,847 B2 3/2008 McGarian et al.
7,343,975 B2 3/2008 Surjaatmadja et al.
7,353,878 B2 4/2008 Themig
7,353,879 B2 4/2008 Todd et al.
7,367,393 B2 5/2008 Vachon
7,377,321 B2 5/2008 Rytlewski
7,377,322 B2 5/2008 Hofman
7,385,523 B2 6/2008 Thomeer et al.
7,387,165 B2 6/2008 Lopez de Cardenas et al.
7,398,825 B2 7/2008 Nguyen et al.
7,416,029 B2 8/2008 Telfer et al.
7,419,002 B2 9/2008 Dybevik et al.
7,422,060 B2 9/2008 Hammami et al.
7,431,090 B2 10/2008 Surjaatmadja et al.
7,431,091 B2 10/2008 Themig et al.
7,464,764 B2 12/2008 Xu
7,478,676 B2 1/2009 East, Jr. et al.
7,503,390 B2 3/2009 Gomez
7,503,398 B2 3/2009 LoGiudice et al.
7,506,689 B2 3/2009 Surjaatmadja et al.
7,510,010 B2 3/2009 Williamson

(56) References Cited

U.S. PATENT DOCUMENTS

| | | | | |
|---|---|---|---|---|
| 7,510,017 | B2 | 3/2009 | Howell et al. | |
| 7,520,327 | B2 | 4/2009 | Surjaatmadja | |
| 7,527,103 | B2 | 5/2009 | Huang et al. | |
| 7,543,641 | B2 | 6/2009 | Contant | |
| 7,571,766 | B2 | 8/2009 | Pauls et al. | |
| 7,575,062 | B2 | 8/2009 | East, Jr. | |
| 7,617,871 | B2 | 11/2009 | Surjaatmadja et al. | |
| 7,628,213 | B2 | 12/2009 | Telfer | |
| 7,637,323 | B2 | 12/2009 | Schasteen et al. | |
| 7,644,772 | B2 | 1/2010 | Avant et al. | |
| 7,661,478 | B2 | 2/2010 | Palmer et al. | |
| 7,665,545 | B2 | 2/2010 | Telfer | |
| 7,673,673 | B2 | 3/2010 | Surjaatmadja et al. | |
| 7,673,677 | B2 | 3/2010 | King et al. | |
| 7,681,645 | B2 | 3/2010 | McMillin et al. | |
| 7,703,510 | B2 | 4/2010 | Xu | |
| 7,735,559 | B2 | 6/2010 | Malone | |
| 7,740,072 | B2 | 6/2010 | Surjaatmadja | |
| 7,740,079 | B2 | 6/2010 | Clayton et al. | |
| 7,748,460 | B2 | 7/2010 | Themig et al. | |
| 7,775,285 | B2 | 8/2010 | Surjaatmadja et al. | |
| 7,779,906 | B2 | 8/2010 | Porter et al. | |
| 7,802,627 | B2 | 9/2010 | Hofman et al. | |
| 7,849,924 | B2 | 12/2010 | Surjaatmadja et al. | |
| 7,849,925 | B2 | 12/2010 | Patel | |
| 7,861,788 | B2 | 1/2011 | Tips et al. | |
| 7,866,396 | B2 | 1/2011 | Rytlewski | |
| 7,866,402 | B2 | 1/2011 | Williamson, Jr. | |
| 7,866,408 | B2 | 1/2011 | Allison et al. | |
| 7,870,907 | B2 | 1/2011 | Lembcke et al. | |
| 7,878,255 | B2 | 2/2011 | Howell et al. | |
| 7,909,108 | B2 | 3/2011 | Swor et al. | |
| 7,926,571 | B2 | 4/2011 | Hofman | |
| 7,934,559 | B2 | 5/2011 | Posevina et al. | |
| 7,946,340 | B2 | 5/2011 | Surjaatmadja et al. | |
| 7,963,331 | B2 | 6/2011 | Surjaatmadja et al. | |
| 8,162,050 | B2 | 4/2012 | Roddy et al. | |
| 8,186,444 | B2 | 5/2012 | Patel | |
| 8,191,625 | B2 | 6/2012 | Porter et al. | |
| 8,215,411 | B2 | 7/2012 | Flores et al. | |
| 8,245,788 | B2 | 8/2012 | Garcia et al. | |
| 8,267,178 | B1 * | 9/2012 | Sommers et al. | 166/334.4 |
| 8,276,674 | B2 | 10/2012 | Lopez de Cardenas et al. | |
| 8,276,675 | B2 | 10/2012 | Williamson et al. | |
| 8,291,980 | B2 | 10/2012 | Fay | |
| 8,297,367 | B2 * | 10/2012 | Chen et al. | 166/386 |
| 8,316,951 | B2 | 11/2012 | Fay et al. | |
| 8,365,824 | B2 | 2/2013 | Phillips | |
| 8,408,314 | B2 | 4/2013 | Patel et al. | |
| 8,418,769 | B2 | 4/2013 | Fay et al. | |
| 8,496,055 | B2 | 7/2013 | Mootoo et al. | |
| 8,505,639 | B2 | 8/2013 | Robison et al. | |
| 8,534,369 | B2 | 9/2013 | deBoer | |
| 8,757,265 | B1 * | 6/2014 | Cuffe et al. | 166/308.1 |
| 2003/0029611 | A1 | 2/2003 | Owens | |
| 2004/0256113 | A1 * | 12/2004 | LoGiudice et al. | 166/381 |
| 2006/0042798 | A1 * | 3/2006 | Badalamenti et al. | 166/285 |
| 2006/0086507 | A1 | 4/2006 | Surjaatmadja et al. | |
| 2006/0157257 | A1 | 7/2006 | Ross et al. | |
| 2007/0102156 | A1 | 5/2007 | Nguyen et al. | |
| 2007/0261851 | A1 | 11/2007 | Surjaatmadja | |
| 2007/0272411 | A1 | 11/2007 | Lopez De Cardenas et al. | |
| 2007/0272413 | A1 | 11/2007 | Rytlewski et al. | |
| 2007/0284114 | A1 | 12/2007 | Swor et al. | |
| 2008/0000637 | A1 | 1/2008 | McDaniel et al. | |
| 2008/0060803 | A1 * | 3/2008 | Badalamenti et al. | 166/242.8 |
| 2008/0060810 | A9 | 3/2008 | Nguyen et al. | |
| 2008/0135248 | A1 | 6/2008 | Talley et al. | |
| 2008/0202764 | A1 | 8/2008 | Clayton et al. | |
| 2008/0264641 | A1 | 10/2008 | Slabaugh et al. | |
| 2009/0084553 | A1 * | 4/2009 | Rytlewski et al. | 166/305.1 |
| 2009/0090501 | A1 | 4/2009 | Hansen et al. | |
| 2009/0223670 | A1 | 9/2009 | Snider | |
| 2009/0272580 | A1 * | 11/2009 | Dolman et al. | 175/48 |
| 2009/0308588 | A1 | 12/2009 | Howell et al. | |
| 2010/0000727 | A1 | 1/2010 | Webb et al. | |
| 2010/0044041 | A1 | 2/2010 | Smith et al. | |
| 2010/0089583 | A1 * | 4/2010 | Xu et al. | 166/298 |
| 2010/0116493 | A1 * | 5/2010 | Irani et al. | 166/264 |
| 2010/0155055 | A1 | 6/2010 | Ash et al. | |
| 2010/0200243 | A1 | 8/2010 | Purkis | |
| 2010/0200244 | A1 | 8/2010 | Purkis | |
| 2011/0036590 | A1 * | 2/2011 | Williamson et al. | 166/373 |
| 2011/0094742 | A1 * | 4/2011 | Badalamenti et al. | 166/285 |
| 2011/0100643 | A1 | 5/2011 | Themig et al. | |
| 2011/0108272 | A1 | 5/2011 | Watson et al. | |
| 2011/0147088 | A1 | 6/2011 | Brunet et al. | |
| 2011/0155380 | A1 | 6/2011 | Frazier | |
| 2011/0155392 | A1 | 6/2011 | Frazier | |
| 2011/0180269 | A1 | 7/2011 | Vestavik | |
| 2011/0192607 | A1 | 8/2011 | Hofman et al. | |
| 2011/0253383 | A1 | 10/2011 | Porter et al. | |
| 2011/0278017 | A1 * | 11/2011 | Themig et al. | 166/373 |
| 2012/0061105 | A1 | 3/2012 | Neer et al. | |
| 2012/0111574 | A1 | 5/2012 | Desranleau et al. | |
| 2012/0160515 | A1 | 6/2012 | Braekke et al. | |
| 2013/0008647 | A1 * | 1/2013 | Dirksen et al. | 166/250.01 |
| 2013/0048290 | A1 * | 2/2013 | Howell et al. | 166/305.1 |
| 2013/0048291 | A1 * | 2/2013 | Merron et al. | 166/305.1 |
| 2013/0048298 | A1 | 2/2013 | Merron et al. | |
| 2013/0255938 | A1 * | 10/2013 | Neer | 166/255.1 |
| 2014/0158370 | A1 | 6/2014 | Porter et al. | |
| 2014/0166290 | A1 | 6/2014 | Howell | |

FOREIGN PATENT DOCUMENTS

| | | | |
|---|---|---|---|
| CN | 102518418 | A | 6/2012 |
| CN | 102518420 | A | 6/2012 |
| EP | 2216500 | A2 | 8/2010 |
| GB | 2321659 | A | 8/1998 |
| GB | 2323871 | A | 10/1998 |
| GB | 2332006 | A | 6/1999 |
| GB | 2415213 | B | 1/2009 |
| WO | 0246576 | A1 | 6/2002 |
| WO | 2004088091 | A1 | 10/2004 |
| WO | 2008070051 | A2 | 6/2008 |
| WO | 2008070051 | A3 | 6/2008 |
| WO | 2008070051 | B1 | 6/2008 |
| WO | 2008071912 | A1 | 6/2008 |
| WO | 2008093047 | A1 | 8/2008 |
| WO | 2009019461 | A1 | 2/2009 |
| WO | 2009029437 | A1 | 3/2009 |
| WO | 2009132462 | A1 | 11/2009 |
| WO | 2010001087 | A2 | 1/2010 |
| WO | 2010001087 | A3 | 1/2010 |
| WO | 2010058160 | A1 | 5/2010 |
| WO | 2010127457 | A1 | 11/2010 |
| WO | 2010128291 | A2 | 11/2010 |
| WO | 2010149644 | A1 | 12/2010 |
| WO | 2011018623 | A2 | 2/2011 |
| WO | 2011018623 | A3 | 2/2011 |
| WO | 2011058325 | A2 | 5/2011 |
| WO | 2011058325 | A3 | 5/2011 |
| WO | 2012037646 | A1 | 3/2012 |
| WO | 2012107730 | A2 | 8/2012 |
| WO | 2012107730 | A3 | 8/2012 |
| WO | 2012107730 | A8 | 8/2012 |
| WO | 2012107731 | A2 | 8/2012 |
| WO | 2012107731 | A3 | 8/2012 |
| WO | 2012164236 | A1 | 12/2012 |
| WO | 2013028385 | A2 | 2/2013 |
| WO | 2013028385 | A3 | 2/2013 |
| WO | 2013048696 | A1 | 4/2013 |
| WO | 2013165643 | A2 | 11/2013 |
| WO | 2013165643 | A3 | 11/2013 |
| WO | 2014004144 | A2 | 1/2014 |

OTHER PUBLICATIONS

Dictionary definition of "valve", accessed Dec. 19, 2014 via thefreedictionary.com.*

Office Action dated Jun. 18, 2013 (41 pages), U.S. Appl. No. 13/025,041, filed Feb. 10, 2011.

(56) References Cited

OTHER PUBLICATIONS

Office Action dated Jun. 18, 2013 (40 pages), U.S. Appl. No. 13/151,457, filed Jun. 2, 2011.
Notice of Allowance dated Jul. 9, 2012 (11 pages), U.S. Appl. No. 12/617,405, filed Nov. 12, 2009.
Notice of Allowance dated Jul. 25, 2012 (9 pages), U.S. Appl. No. 12/539,392, filed Aug. 11, 2009.
Supplemental Notice of Allowability dated Aug. 22, 2012 (6 pages), U.S. Appl. No. 12/539,392, filed Aug. 11, 2009.
Foreign communication from a related counterpart application—International Search Report and Written Opinion, PCT/US2013/035122, Dec. 18, 2013, 13 pages.
Foreign communication from a related counterpart application—International Search Report and Written Opinion, PCT/US2013/046109, Dec. 18, 2013, 10 pages.
"Omega Tracer Deployment Valve (TDV)," XP054975262, Oct. 2, 2009, 1 page, http://www.youtube.com/watch?v=9nBh22_7EfA, Omega Completion Technology, Ltd.
Foreign communication from a related counterpart application—International Preliminary Report on Patentability, PCT/GB2012/000140, Dec. 2, 2013, 6 pages.
Foreign communication from a related counterpart application—International Preliminary Report on Patentability, PCT/GB2008/002646, Feb. 9, 2010, 6 pages.
Foreign communication from a related counterpart application—International Preliminary Report on Patentability, PCT/GB2007/004628, Jun. 16, 2009, 6 pages.
Foreign communication from a related counterpart application—International Preliminary Report on Patentability, PCT/GB2009/001505, Feb. 15, 2011, 5 pages.
Foreign communication from a related counterpart application—International Preliminary Report on Patentability, PCT/GB2009/002693, May 24, 2011, 6 pages.
Foreign communication from a related counterpart application—International Preliminary Report on Patentability, PCT/GB2010/001524, Feb. 14, 2012, 7 pages.
Foreign communication from a related counterpart application—International Preliminary Report on Patentability, PCT/GB2010/002090, May 15, 2012, 8 pages.
Foreign communication from a related counterpart application—International Preliminary Report on Patentability, PCT/GB2012/000139, Aug. 13, 2013, 6 pages.
Foreign communication from a related counterpart application—International Preliminary Report on Patentability, PCT/GB2012/000141, Aug. 13, 2013, 7 pages.
Office Action dated Feb. 4, 2014 (61 pages), U.S. Appl. No. 13/215,553, filed Aug. 23, 2011.
Filing receipt and specification entitled "System and Method for Servicing a Wellbore," by Jesse Cale Porter, et al., filed Jan. 15, 2014 as U.S. Appl. No. 14/156,232.
Foreign communication from a related counterpart application—International Search Report and Written Opinion, PCT/GB2012/000139, Dec. 19, 2012, 11 pages.
Foreign communication from a related counterpart application—International Search Report and Written Opinion, PCT/US2012/054161, Feb. 8, 2013, 11 pages.
Office Action dated May 8, 2013 (51 pages), U.S. Appl. No. 13/025,039, filed Feb. 10, 2011.
Office Action (Final) dated Oct. 11, 2013 (17 pages), U.S. Appl. No. 13/025,039, filed Feb. 10, 2011.
Foreign communication from a related counterpart application—Invitation to Pay Additional Fees, PCT/US2012/050564, Nov. 5, 2013, 4 pages.
Foreign communication from a related counterpart application—International Search Report and Written Opinion, PCT/GB2012/000141, Dec. 20, 2012, 11 pages.
Foreign communication from a related counterpart application—International Search Report and Written Opinion, PCT/US2012/050564, Feb. 14, 2014, 16 pages.
Office Action dated Feb. 25, 2014 (79 pages), U.S. Appl. No. 13/156,155, filed Jun. 8, 2011.
Filing receipt and specification entitled "A Method for Individually Servicing a Plurality of Zones of a Subterranean Formation," by Matthew Todd Howell, filed Feb. 24, 2014 as U.S. Appl. No. 14/187,761.
Foreign communication from a related counterpart application—International Search Report and Written Opinion, PCT/GB2012/000140, May 30, 2012, 11 pages.
Foreign communication from a related counterpart application—International Search Report and Written Opinion, PCT/GB2008/002646, Dec. 11, 2008, 8 pages.
Foreign Communication from a related counterpart application—International Search Report and Written Opinion, PCT/GB2007/004628, Feb. 26, 2008, 8 pages.
Foreign commuunication from a related counterpart application—International Search Report and Written Opinion, PCT/GB2009/001505, Feb. 8, 2011, 8 pages.
Foreign communication from a related counterpart application—International Search Report and Written Opinion, PCT/GB2009/002693, Mar. 2, 2010, 8 pages.
Foreign communication from a related counterpart application—International Search Report and Written Opinion, PCT/GB2010/001524, Apr. 13, 2011, 11 pages.
Foreign communication from a related counterpart application—International Search Report and Written Opinion, PCT/GB2010/002090, Aug. 12, 2011, 11 pages.
Halliburton brochure entitled "Delta Stim® Completion Service," Sep. 2008, 4 pages, Halliburton.
Halliburton brochure entitled "Delta Stim™ Sleeve," Mar. 2007, 2 pages, Halliburton.
Halliburton brochure entitled "Swellpacker® cable system," Aug. 2008, 2 pages, Halliburton.
Halliburton brochure entitled "RapidFrac™ System," Mar. 2011, 3 pages.
Halliburton brochure entitled "sFrac™ Valve," Jun. 2010, 3 pages, Halliburton.
Halliburton Marketing Data Sheet, Sand Control, EquiFlow™ Inflow Control Devices, HO5600,Jan. 2008, pp. 1-2.
The Lee Company brochure entitled "Meet the EFS family," http://www.theleeco.com/EFSWEB2.NSF/Products! OpenPage, Apr. 21, 2009, 1 page.
The Lee Company brochure entitled "Meet the precision microhydraulics family," http://www.theleeco.com/LEEWEB2.NSF/AeroStart!OpenPage, Apr. 21, 2009, 2 pages.
Lohm calculator for gas flow, http://www.theleeco.com/EFSWEB2.NSF/airlohms.htm, Apr. 21, 2009, 2 pages, courtesy of The Lee Company.
Lohm calculator for liquid flow, http://www.theleeco.com/EFSWEB2.NSF/flowcalc.htm, Apr. 21, 2009, 2 pages, courtesy of The Lee Company.
Office Action (Final) dated Sep. 15, 2009 (12 pages), U.S. Appl. No. 11/609,128, filed Dec. 11, 2006.
Office Action dated Feb. 18, 2009 (18 pages), U.S. Appl. No. 11/609,128, filed Dec. 11, 2006.
Office Action dated Jun. 24, 2010 (13 pages), U.S. Appl. No. 12/139,604, filed Jun. 16, 2008.
Office Action dated Dec. 22, 2009 (18 pages), U.S. Appl. No. 12/139,604, filed Jun. 16, 2008.
Office Action (Final) dated Aug. 12, 2011 (12 pages), U.S. Appl. No. 12/166,257, filed Jul. 1, 2008.
Office Action dated Mar. 31, 2011 (19 pages), U.S. Appl. No. 12/166,257, filed Jul. 1, 2008.
Office Action dated Aug. 9, 2011 (24 pages), U.S. Appl. No. 12/539,392, filed Aug. 11, 2009.
Office Action dated Apr. 4, 2012 (21 pages), U.S. Appl. No. 12/539,392, filed Aug. 11, 2009.
Office Action dated Mar. 28, 2012 (39 pages), U.S. Appl. No. 12/617,405, filed Nov. 12, 2009.
Packers Plus brochure entitled "Achieve immediate production; StackFRAC ® HD," Mar. 11, 2011, 4 pages.
Packers Plus brochure entitled "High Density Multi-Stage Fracturing System; StackFRAC ® HD," Apr. 20, 2010, 2 pages.

(56) References Cited

OTHER PUBLICATIONS

Packers Plus ® Case Study entitled "Packers Plus launches the StackFRAC ® HD "High Density" Multi-Stage Fracturing System to fulfill operator demand for more stimulation stages to increase production," 1 page.
Patent application entitled "A Method for individually servicing a plurality of zones of a subterranean formation," by Matthew Todd Howell, filed Feb. 10, 2011 as U.S. Appl. No. 13/025,039.
Patent application entitled "System and method for servicing a wellbore," by Jesse Cale Porter, et al., filed Feb. 10, 2011 as U.S. Appl. No. 13/025,041.
Patent application entitled "System and method for servicing a wellbore," by Jesse Cale Porter, et al., filed Jun. 2, 2011 as U.S. Appl. No. 13/151,457.
Patent application entitled "System and method for servicing a wellbore," by Matthew James Merron, et al., filed Aug. 23, 2011 as U.S. Appl. No. 13/215,553.
Patent application entitled "Responsively activated wellbore stimulation assemblies and methods of using the same," by Brock William Miller, filed Jun. 8, 2011 as U.S. Appl. No. 13/156,155.
Patent application entitled "Responsively activated wellbore stimulation assemblies and methods of using the same," by William Mark Norrid, et al., filed Sep. 29, 2011 as U.S. Appl. No. 13/248,145.
Patent application entitled "Delayed activation activatable stimulation assembly," by Matthew James Merron, filed Apr. 30, 2012 as U.S. Appl. No. 13/460,453.
Office Action (Final) dated May 22, 2014 (15 pages), U.S. Appl. No. 13/215,553, filed Aug. 23, 2011.
Notice of Allowance dated Aug. 11, 2014 (20 pages), U.S. Appl. No. 13/156,155, filed Jun. 8, 2011.
Office Action dated Aug. 21, 2014 (69 pages), U.S. Appl. No. 13/460,453, filed Apr. 30, 2012.
Foreign communication from a related counterpart application—Chinese Office Action with English translation, Application No. 201080059511.0, Mar. 5, 2014, 21 pages.
Foreign communication from a related counterpart application—Australian Examination Report, Application No. 2010317706, May 21, 2014, 4 pages.
Foreign communication from a related counterpart application—Canadian Office Action, CA 2,768,756, Apr. 24, 2014, 2 pages.
Foreign communication from a related counterpart application—International Search Report and Written Opinion, PCT/GB2010/001524, Apr. 13, 2011, 10 pages.
Foreign communication from a related counterpart application—International Preliminary Report on Patentability, PCT/US2012/054161, Apr. 1, 2014, 6 pages.

* cited by examiner

SYSTEM AND METHOD FOR SERVICING A WELLBORE

CROSS-REFERENCE TO RELATED APPLICATIONS

The subject matter of this application is related to commonly owned U.S. patent application Ser. No. 12/539,392, published as US 2011/0036590 A1 and entitled "System and method for servicing a wellbore," by Jimmie Robert Williamson, et al., filed Aug. 11, 2009. The subject matter of this application is also related to commonly owned U.S. patent application Ser. No. 13/025,041 entitled "System and method for servicing a wellbore," by Porter, et al., filed Feb. 10, 2011. The subject matter of this application is also related to commonly owned U.S. patent application Ser. No. 13/025,039 entitled "A method for individually servicing a plurality of zones of a subterranean formation," by Howell, filed Feb. 10, 2011. Each of these applications is incorporated by reference herein, in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid and/or a perforating fluid may be introduced into a portion of a subterranean formation penetrated by a wellbore at a hydraulic pressure sufficient to create and/or extend at least one fracture therein. Such a subterranean formation stimulation treatment may increase hydrocarbon production from the well.

Subterranean formations that contain hydrocarbons are sometimes non-homogeneous in their composition along the length of wellbores that extend into such formations. It is sometimes desirable to treat and/or otherwise manage the differing formation zones differently. In order to adequately induce the formation of fractures within such zones, it may be advantageous to introduce a stimulation fluid simultaneously via multiple stimulation assemblies. To accomplish this, it is necessary to configure multiple stimulation assemblies for the simultaneous communication of fluid via those stimulation assemblies. However prior art apparatuses, systems, and methods have failed to provide a way in which to efficiently, effectively, and reliably so-configure multiple stimulation assemblies.

Accordingly, there exists a need for improved apparatuses, systems, and methods for treating multiple zones of a wellbore.

SUMMARY

Disclosed herein is a wellbore servicing tool comprising a housing at least partially defining an axial flowbore, the housing comprising one or more ports, a sliding sleeve, the sliding sleeve being slidably positioned within the housing and transitionable from a first position in which the sliding prevents fluid communication via a route of fluid communication from the axial flowbore to an exterior of the housing via the one or more ports, to a second position in which the sliding sleeve allows fluid communication via the route of fluid communication from the axial flowbore to an exterior of the housing via the one or more ports, and a fluid delay system configured to retain the sliding sleeve in the first position until actuated and to allow the sliding sleeve to transition from the first position to the second position at a controlled rate when actuated, wherein the fluid delay system is actuatable via a wireless signal.

Also disclosed herein is a wellbore servicing method comprising positioning a wellbore servicing system within a wellbore penetrating a subterranean formation, the wellbore servicing system comprising a first wellbore servicing tool, the first wellbore servicing tool comprising a housing at least partially defining an axial flowbore, the housing comprising one or more ports, a sliding sleeve, the sliding sleeve being slidably positioned within the housing and transitionable from a first position in which the sliding sleeve obscures fluid communication via a route of fluid communication from the axial flowbore to an exterior of the housing via the one or more ports, to a second position in which the sliding allows fluid communication via the route of fluid communication from the axial flowbore to an exterior of the housing via the one or more ports, and a fluid delay system configured to retain the sliding sleeve in the first position until actuated and to allow the sliding sleeve to transition from the first position to the second position at a controlled rate when actuated, communicating a first wireless signal to the fluid delay system of the first wellbore servicing tool, wherein receipt of the first wireless signal by the fluid delay system of the first wellbore servicing tool is effective to actuate the fluid delay system of the first wellbore servicing tool, and communicating a wellbore servicing fluid to a first zone of the subterranean formation via the one or more ports of the first wellbore servicing tool.

Further disclosed herein is a wellbore servicing method comprising positioning a wellbore servicing system within a wellbore penetrating a subterranean formation, the wellbore servicing system comprising a first wellbore servicing tool, the first wellbore servicing tool being configured in a first mode and transitionable from the first mode to a second mode and from the second mode to a third mode, the first wellbore servicing tool comprising a housing at least partially defining an axial flowbore, the housing comprising one or more ports, a sliding sleeve, the sliding sleeve being slidably positioned within the housing, and a fluid delay system, communicating a first wireless signal to the fluid delay system of the first wellbore servicing tool, wherein receipt of the first wireless signal by the fluid delay system of the first wellbore servicing tool is effective to transition the first wellbore servicing tool from the first mode to the second mode, allowing the first wellbore servicing tool to transition from the second mode to the third mode, and communicating a wellbore servicing fluid to a first zone of the subterranean formation via the one or more ports of the first wellbore servicing tool.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
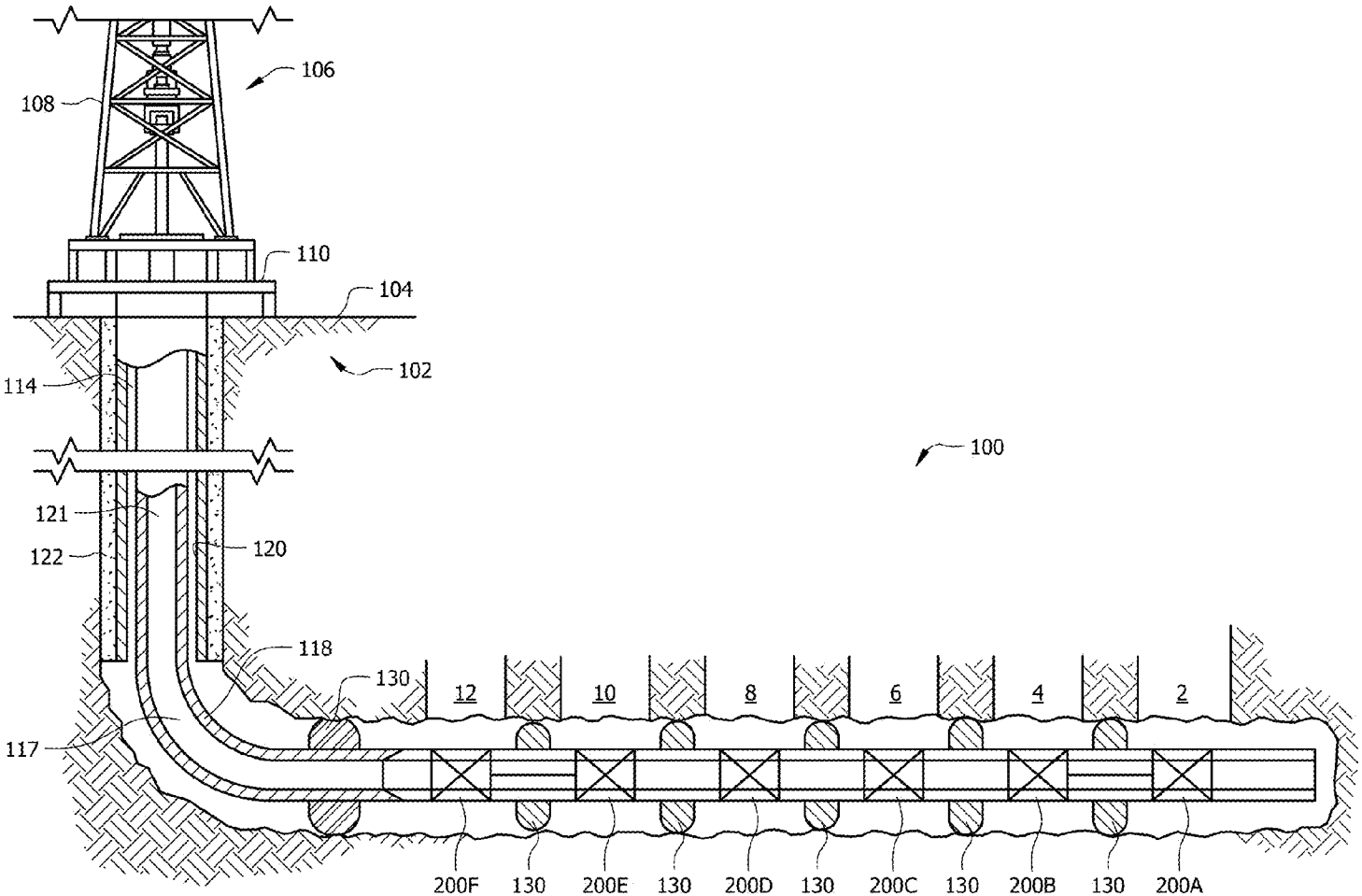
FIG. 1 is a cut-away view of an embodiment of a wellbore servicing system comprising a plurality of activatable stimulation assemblies (ASAs) according to the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly, disclosed herein are one or more of embodiments of an activatable stimulation assembly (ASA). Also disclosed herein are one or more embodiments of a wellbore servicing system comprising a one or more ASAs. Also disclosed herein are one or more embodiments of a method of servicing a wellbore employing an ASA and/or a system comprising one or more ASAs.

Referring to FIG. 1, an embodiment of an operating environment in which such wellbore servicing apparatuses, systems, and methods may be employed is illustrated. It is noted that although some of the figures may exemplify horizontal or vertical wellbores, the principles of the apparatuses, systems, and methods disclosed herein may be similarly applicable to horizontal wellbore configurations, conventional vertical wellbore configurations, and combinations thereof. Therefore, unless otherwise noted, the horizontal or vertical nature of any figure is not to be construed as limiting the wellbore to any particular configuration.

As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 comprises a derrick 108 with a rig floor 110 through which a tubular string (e.g., a drill string, a tool string, a segmented tubing string, a jointed tubing string, a casing string, or any other suitable conveyance, or combinations thereof) generally defining an axial flowbore may be positioned within or partially within the wellbore. In an embodiment, the tubular string may comprise two or more concentrically positioned strings of pipe or tubing (e.g., a first work string may be positioned within a second work string). The drilling or servicing rig 106 may be conventional and may comprise a motor driven winch and other associated equipment for lowering the tubular string into the wellbore 114. Alternatively, a mobile workover rig, a wellbore servicing unit (e.g., coiled tubing units), or the like may be used to lower the work string into the wellbore 114. While FIG. 1 depicts a stationary drilling rig 106, one of ordinary skill in the art will readily appreciate that mobile workover rigs, wellbore servicing units (such as coiled tubing units), and the like may be employed.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In the embodiment of FIG. 1, at least a portion of the wellbore 114 is lined with a casing string and/or liner 120 defining an axial flowbore 121, the casing string 120 being partially secured into position against the formation 102 in a conventional manner with cement 122. In alternative operating environments, the wellbore 114 may be partially or fully uncased and/or fully or partially uncemented.

In the embodiment of FIG. 1, a wellbore servicing system 100 is illustrated comprising a first ASA 200A, a second ASA 200B, a third ASA 200C, a fourth ASA 200D, a fifth ASA 200E, and a sixth ASA 200F, incorporated within the casing string 120 and positioned proximate and/or substantially adjacent to a first, second, third, fourth, fifth, and sixth subterranean formation zones 2, 4, 6, 8, 10, and 12, respectively. Although the embodiment of FIG. 1 illustrates six ASAs, one of skill in the art viewing this disclosure will appreciate that any suitable number of ASAs may be similarly incorporated within a casing string such as casing string 120, for example, 1, 2, 3, 4, 5, 7, 8, 9, 10, or more ASAs. In the embodiment of FIG. 1, the wellbore servicing system 100 is incorporated within a liner 118 generally defining an axial flowbore 117. Additionally, although the embodiment of FIG. 1 illustrates the wellbore servicing system 100 incorporated within liner 118, a similar wellbore servicing system may be similarly incorporated within a casing string (e.g., a second casing string), or within a suitable tubular string (e.g., a work string, a drill string, a production tubing string, a tool string, a segmented tubing string, a jointed tubing string, a coiled-tubing string, or any other suitable conveyance, or combinations thereof), as may be appropriate for a given servicing operation. Additionally, while in the embodiment of FIG. 1, a single ASA is located and/or positioned substantially adjacent to each zone (e.g., each of zones 2, 4, 6, 8, 10, and 12); in alternative embodiments, two or more ASAs may be positioned proximate and/or substantially adjacent to a given zone, alternatively, a given single ASA may be positioned adjacent to two or more zones.

In the embodiment of FIG. 1, the wellbore servicing system 100 further comprises a plurality of wellbore isolation devices 130. In the embodiment of FIG. 1, the wellbore isolation devices 130 are positioned between adjacent ASAs 200A-200F, for example, so as to isolate the various formation zones 2, 4, 6, 8, 10, and/or 12. Alternatively, two or more adjacent formation zones may remain unisolated. Suitable wellbore isolation devices are generally known to those of skill in the art and include but are not limited to packers, such as mechanical packers and swellable packers (e.g., Swellpackers™, commercially available from Halliburton Energy Services, Inc.), sealant compositions such as cement, or combinations thereof.

Figure 2A:
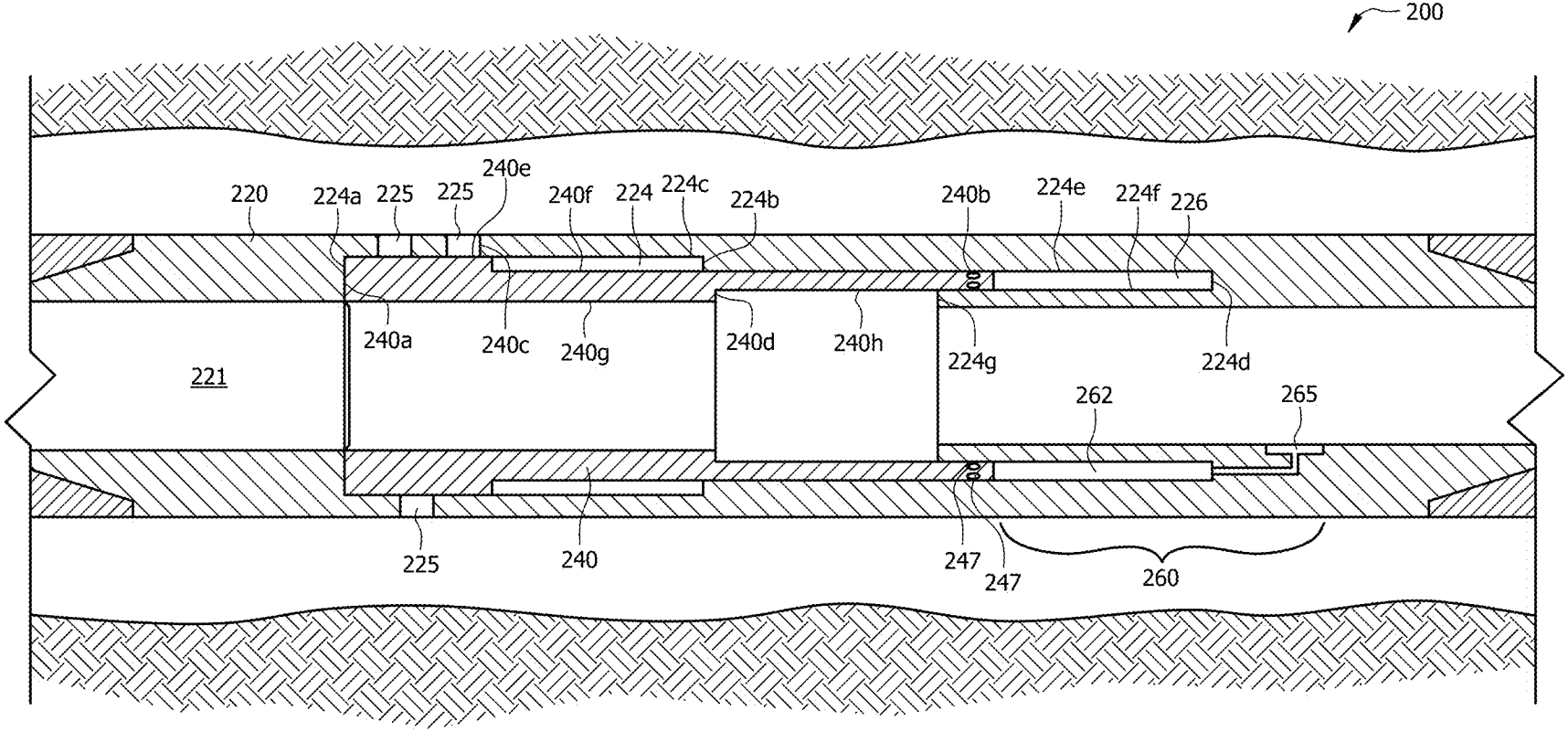
FIG. 2A is a cross-sectional view of a first embodiment of an ASA in an first mode.
Figure 2B:
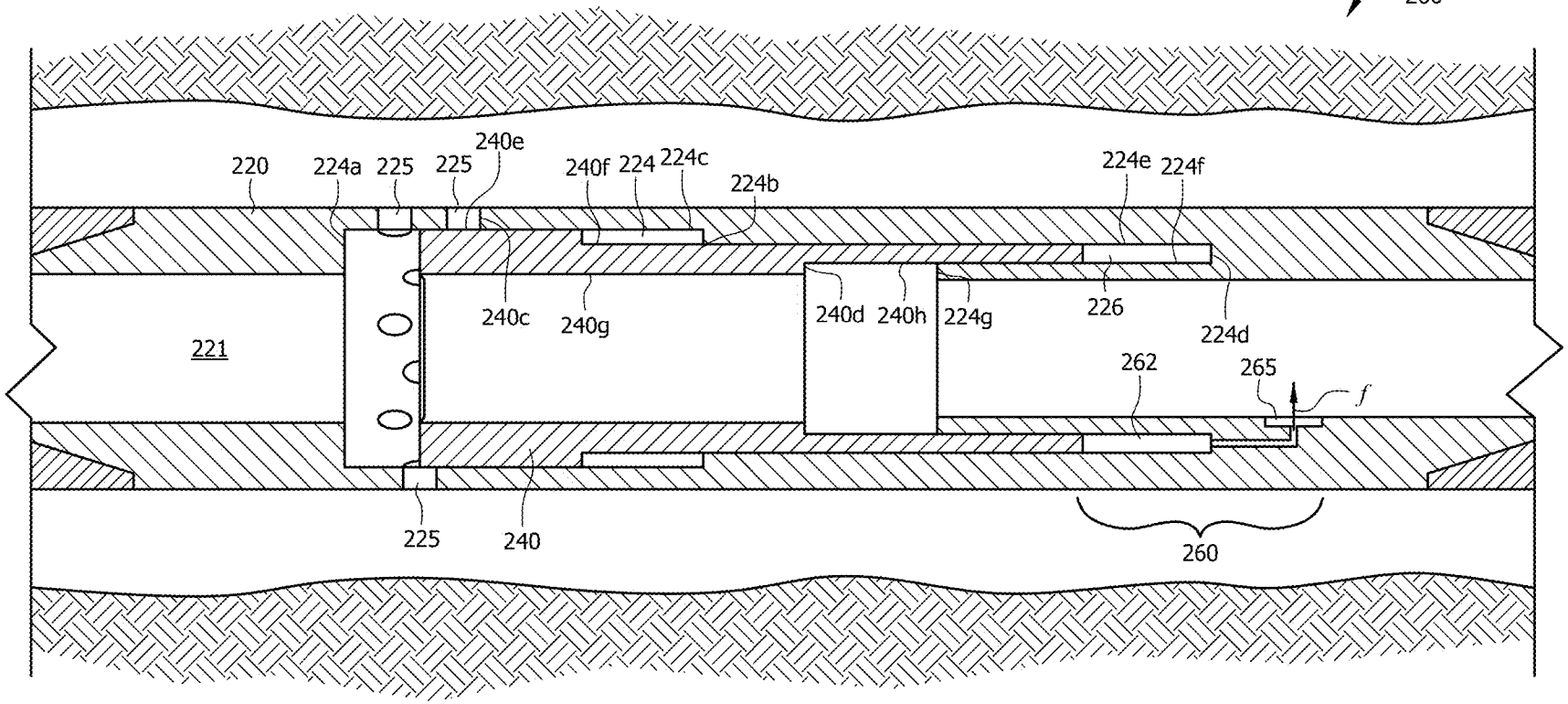
FIG. 2B is a cross-sectional view of the first embodiment of an ASA in an second mode.
Figure 2C:
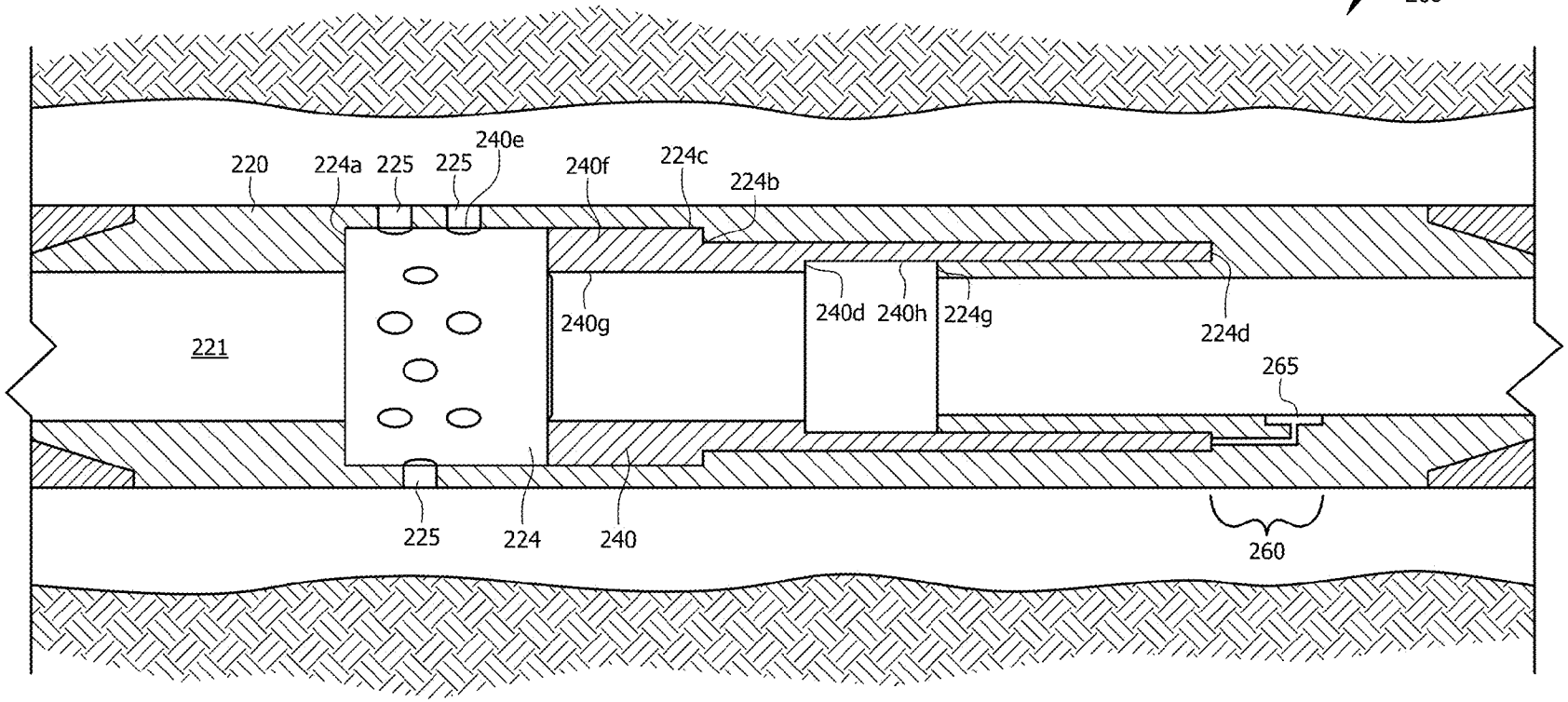
FIG. 2C is a cross-sectional view of the first embodiment of an ASA in an third mode.
Figure 3A:
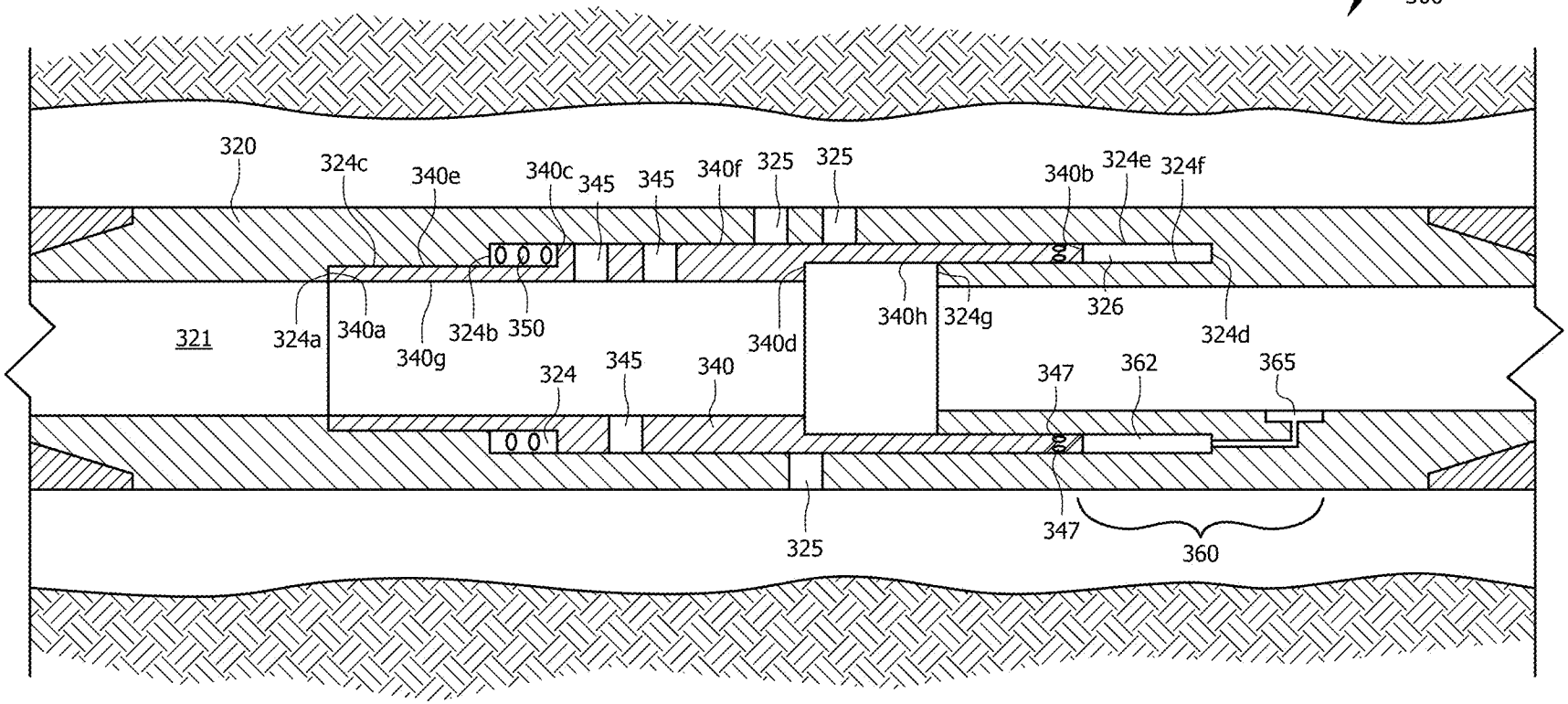
FIG. 3A is a cross-sectional view of a second embodiment of an ASA in an first mode.
Figure 3B:
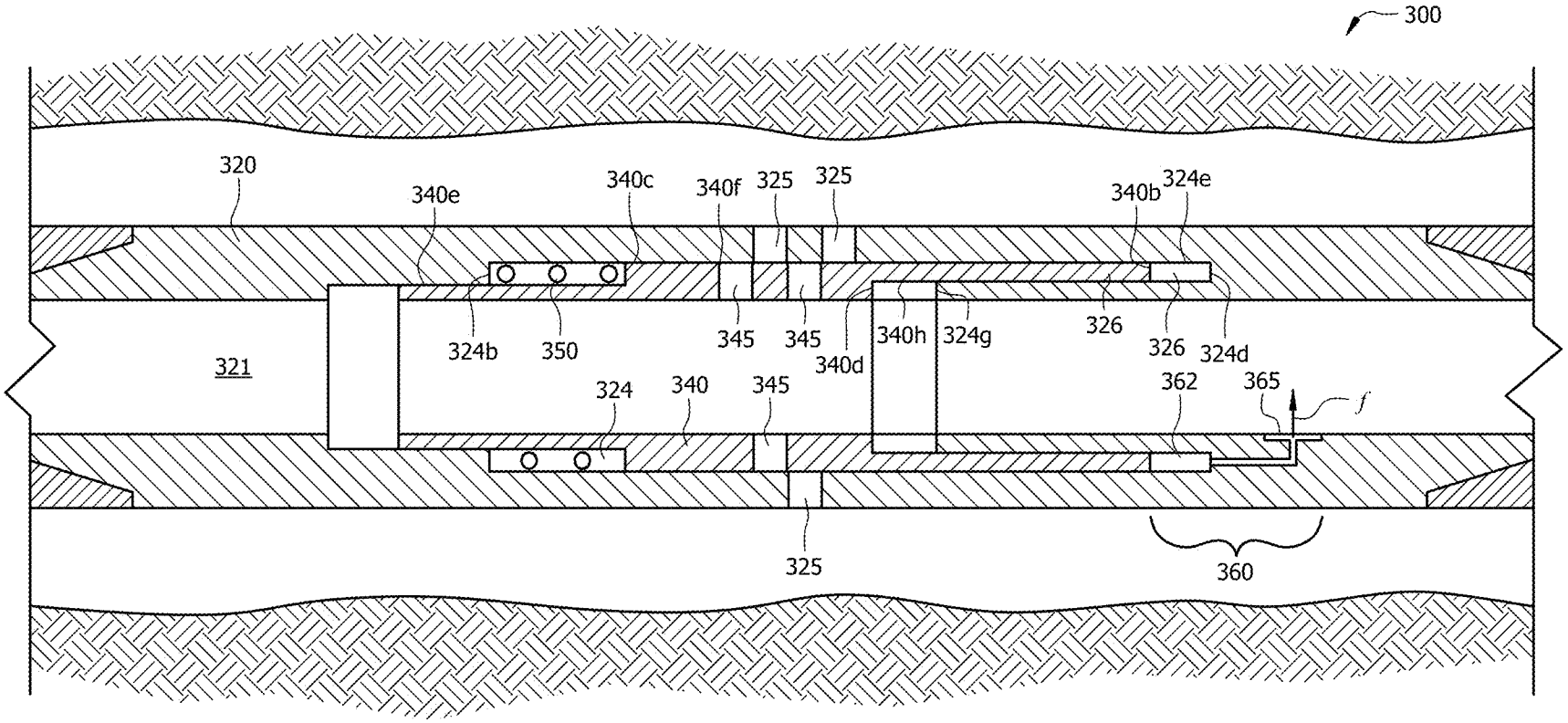
FIG. 3B is a cross-sectional view of the second embodiment of an ASA in an second mode.
Figure 3C:
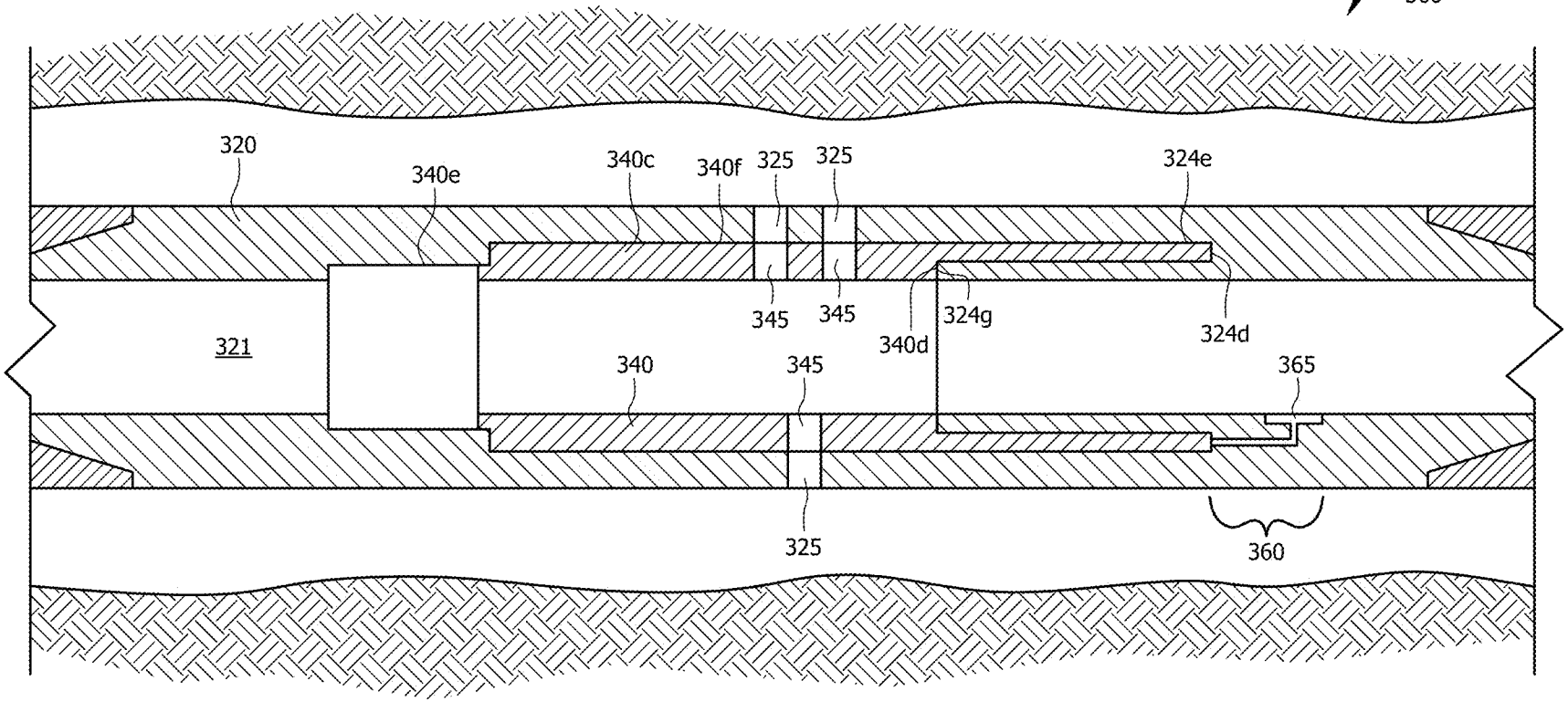
FIG. 3C is a cross-sectional view of the second embodiment of an ASA in an third mode.

In an embodiment, each of the ASAs (cumulatively and non-specifically referred to as ASA 200 in the embodiment illustrated in FIGS. 2A, 2B, and 2C, or, ASA 300 in the embodiment illustrated in FIGS. 3A, 3B, and 3C) generally comprises a housing 220 or 320, a sliding sleeve 240 or 340, and, a fluid delay system 260 or 360. As will be disclosed herein, the housing may comprise one or more ports 225/325 generally providing a route of fluid communication from an interior of the ASA to an exterior of the ASA. As will also be disclosed herein the sliding sleeve may be movable from a first position relative to the housing, in which the sliding sleeve obstructs the ports 225/325 (e.g., so as to disallow fluid communication via the ports), to a second position relative to the housing, in which the sliding sleeve does not obstruct the ports 225/325 (e.g., so as to allow fluid communication via the ports).

In one of more of the embodiments disclosed herein, the ASA may be transitionable from a "first" mode or configuration to a "second" mode or configuration and from the second mode or configuration to a "third" mode or configuration.

In an embodiment, when the ASA is in the first mode, also referred to as a "locked-deactivated," "run-in," or "installation," mode or configuration, the ASA may be configured such that the sliding sleeve is retained in the first position by the delay system. As such, in the first mode, the ASA may be configured to not permit fluid communication via the ports. The locked-deactivated mode may be referred to as such, for example, because the sliding sleeve is selectively locked in position relative to the housing.

In an embodiment, when the ASA is in the second mode, also referred to as an "unlocked-deactivated," or "delay" mode or configuration, the ASA may be configured such that relative movement between the sliding sleeve and the housing may be delayed insofar as (1) such relative movement occurs but occurs at a reduced and/or controlled rate, (2) such relative movement is delayed until the occurrence of a selected condition, or (3) combinations thereof. As such, in the second mode, the ASA may be configured to not permit and/or to not fully permit fluid communication via the ports. The unlocked-deactivated or delay mode may be referred to as such, for example, because the sliding sleeve is not locked relative to the housing, but the sliding sleeve is not in the second position, and thus the ASA remains deactivated, except as allowed by the fluid delay system.

In an embodiment, when the ASA is in the third mode, also referred to as an "activated" or "fully-open mode," the ASA may be configured such that the sliding sleeve has transitioned to the second position. As such, in the third mode, the ASA may be configured to permit fluid communication via the ports.

At least two embodiments of an ASA are disclosed herein below. A first embodiment of such an ASA (e.g., ASA 200) is disclosed with respect to FIGS. 2A, 2B, and 2C, and a second embodiment of such an ASA (e.g., ASA 300) is disclosed with respect to FIGS. 3A, 3B, and 3C. Referring now to FIGS. 2A and 3A, 2B and 3B, and 2C and 3C, respectively, embodiments of ASAs 200/300 are illustrated in the locked-deactivated mode, the unlocked-deactivated mode, and the activated mode, respectively.

In an embodiment, the housing 220/320 may be characterized as a generally tubular body defining an axial flowbore 221/321 having a longitudinal axis. The axial flowbore 221/321 may be in fluid communication with the axial flowbore 113 defined by the casing string 120. For example, a fluid communicated via the axial flowbore 113 of the work string 112 will flow into and the axial flowbore 221/321.

In an embodiment, the housing 220/320 may be configured for connection to and or incorporation within a casing string such as liner 118. For example, the housing 220/320 may comprise a suitable means of connection to the liner 118 (e.g., to a liner member such as a joint). For example, in an embodiment, the terminal ends of the housing 220/320 comprise one or more internally or externally threaded surfaces, as may be suitably employed in making a threaded connection to the liner 118. Alternatively, an ASA may be incorporated within a casing string (or, alternatively, any other suitable tubular string, such as a casing string or work string) by any suitable connection, such as, for example, via one or more quick-connector type connections. Suitable connections to a casing string member will be known to those of skill in the art viewing this disclosure.

In an embodiment, the housing 220/320 may comprise a unitary structure; alternatively, the housing 220/320 may be comprise two or more operably connected components (e.g., two or more coupled sub-components, such as by a threaded connection). Alternatively, a housing like housing 220/320 may comprise any suitable structure, such suitable structures will be appreciated by those of skill in the art with the aid of this disclosure.

In an embodiment, the housing 220/320 may comprise one or more ports (e.g., ports 225 in the embodiment of FIGS. 2A, 2B, and 2C and ports 325 in the embodiment of FIGS. 3A, 3B, and 3C) suitable for the communication of fluid from the axial flowbore 221/321 of the housing 220/320 to a proximate subterranean formation zone when the ASA 200 is so-configured (e.g., when the ASA 200 is activated). For example, in the embodiments of FIGS. 2A and 3A, the ports 225/325 within the housing 220/320 are obstructed, as will be discussed herein, and will not communicate fluid from the axial flowbore 221/321 to the surrounding formation. In the embodiments of FIGS. 2C and 3C, the ports 225/325 within the housing 220/320 are unobstructed, as will be discussed herein, and may communicate fluid from the axial flowbore 221/321 to the surrounding formation. In an embodiment, the ports 225/325 may be fitted with one or more pressure-altering devices (e.g., nozzles, erodible nozzles, fluid jets, or the like). In an additional embodiment, the ports 225/325 may be fitted with plugs, screens, covers, or shields, for example, to prevent debris from entering the ports 225/325.

In an embodiment, the housing 220/320 comprises a sliding sleeve recess. For example, in the embodiment of FIGS. 2A, 2B, and 2C, the housing 220 comprises a sliding sleeve recess 224 and, in the embodiment of FIGS. 3A, 3B, and 3C, the housing 320 comprises a sliding sleeve recess 324. The sliding sleeve recess 224/324 may generally comprise a passageway in which at least a portion of the sliding sleeve (e.g., sliding sleeve 240 in the embodiments of FIGS. 2A, 2B, and 2C, and sliding sleeve 340 in the embodiments of FIGS. 3A, 3B, and 3C) may move longitudinally, axially, radially, or combinations thereof within the axial flowbore 221/321. In an embodiment, the sliding sleeve recess 224/324 may comprise one or more grooves, guides, or the like, for example, to align and/or orient the sliding sleeve 240/340. In the embodiment of FIGS. 2A, 2B, and 2C the sliding sleeve recess 224 is generally defined by a first shoulder 224*a*, a second shoulder 224*b*, a first outer cylindrical surface 224*c* extending between the first shoulder 224*a* and the second shoulder 224*b*, a third shoulder 224*d*, a second outer cylindrical surface 224*e* extending between the second shoulder 224*b* and the third shoulder 224*d*, and an inner cylindrical surface 224*f* extending at least partially over the second outer cylindrical surface 224*e* and terminating at a fourth shoulder 324*g*, thereby at least partially defining an annular space 226 (e.g., a substantially cylindrical annular space) between the second outer cylindrical surface 224*e* and the inner cylindrical surface 224*f*. In the embodiment of FIGS. 2A, 2B, and 2C, the first outer cylindrical surface 224*c* may be characterized as having a diameter greater than the diameter of the second outer cylindrical surface 224*e*. Also, in the embodiment of FIGS. 2A, 2B, and 2C, the diameter of the second outer cylindrical surface 224*e* may be characterized as greater than the diameter of the inner cylindrical surface 224*f*. Similarly, in the embodiment of FIGS. 3A, 3B, and 3C, the sliding sleeve recess 324 is generally defined by a first shoulder 324*a*, a second shoulder 324*b*, a first outer cylindrical surface 324*c* extending between the first shoulder 324*a* and the second shoulder 324*b*, a third shoulder 324*d*, a second outer cylindrical surface 324*e* extending between the second shoulder 324*b* and the third shoulder 324*c*, and an inner cylindrical surface 324*f* extending at least partially over the second outer cylindrical surface 324*e* and terminating at a fourth shoulder 324*g*, thereby at least partially defining an annular space 326 (e.g., a substantially cylindrical annular space) between the second outer cylindrical surface 324*e* and the inner cylindrical surface 324*f*. In the embodiment of FIGS. 3A, 3B, and 3C, the second outer cylindrical surface 324*e* may be characterized as having a diameter greater than the diameter of the first outer cylindrical surface 324*c*. Also, in the embodiment of FIGS. 3A, 3B, and 3C, the diameter of the second outer cylindrical surface 324*e* may be characterized as greater than the diameter of the inner cylindrical surface 324*f*.

In an embodiment, the sliding sleeve 240/340 generally comprises a cylindrical or tubular structure. In the embodiment of FIGS. 2A, 2B, and 2C, the sliding sleeve 240 generally comprises an upper orthogonal face 240*a*, a lower orthogonal face 240*b*, an outer shoulder 240*c*, an inner shoulder 240*d*, a first outer cylindrical surface 240*e* extending between the upper orthogonal face 240*a* and the outer shoulder 240*c*, a second outer cylindrical surface 240*f* extending between the outer shoulder 240*c* and the lower orthogonal face 240*b*, a first inner cylindrical surface 240*g* extending between the upper orthogonal face 240*a* and the inner shoulder 240*d*, a second inner cylindrical surface 240*h* extending between the inner shoulder 240*d* and the lower orthogonal face 240*b*. In the embodiment of FIGS. 2A, 2B, and 2C, the diameter of the first outer cylindrical surface 240*e* may be characterized as greater than the diameter of the second outer cylindrical surface 240*f*. In the embodiment of FIGS. 3A, 3B, and 3C, the sliding sleeve 340 generally comprises an upper orthogonal face 340*a*, a lower orthogonal face 340*b*, an outer shoulder 340*c*, an inner shoulder 340*d*, a first outer cylindrical surface 340*e* extending between the upper orthogonal face 340*a* and the outer shoulder 340*c*, a second outer cylindrical surface 340*f* extending between the outer shoulder 340*c* and the lower orthogonal face 340*b*, a first inner cylindrical surface 340*g* extending between the upper orthogonal face 340*a* and the inner shoulder 340*d*, and a second inner cylindrical surface 340*h* extending between the inner shoulder 340*d* and the lower orthogonal face 340*b*. In the embodiment of FIGS. 3A, 3B, and 3C, the diameter of the first outer cylindrical surface 340*e* may be characterized as less than the diameter of the second outer cylindrical surface 340*f*.

In an embodiment, the sliding sleeve 240/340 may comprise a single component piece. In an alternative embodiment, a sliding sleeve like the sliding sleeve 240/340 may comprise two or more operably connected or coupled component pieces (e.g., a collar welded about a tubular sleeve).

In an embodiment, the sliding sleeve 240/340 may be slidably and concentrically positioned within the housing 220/320. In the embodiment of FIGS. 2A, 2B, and 2C, at least a portion of the sliding sleeve 240 may be positioned within the sliding sleeve recess 224 of the housing 220. For example, in the embodiment of FIGS. 2A, 2B, and 2C, at least a portion of the first outer cylindrical surface 240*e* of the sliding sleeve 240 may be slidably fitted against at least a portion of the first outer cylindrical surface 224*c*, at least a portion of the second outer cylindrical surface 240*f* may be slidably fitted against at least a portion of the second outer cylindrical surface 224*e*, and at least a portion of the second inner cylindrical surface 240*h* may be slidably fitted against at least a portion of the inner cylindrical surface 224*f*. Similarly, in the embodiment of FIGS. 3A, 3B, and 3C, at least a portion of the first outer cylindrical surface 340*e* of the sliding sleeve 340 may be slidably fitted against at least a portion of the first outer cylindrical surface 324*c*, at least a portion of the second outer cylindrical surface 340*f* may be slidably fitted against at least a portion of the second outer cylindrical surface 324*e*, and at least a portion of the second inner cylindrical surface 340*h* may be slidably fitted against at least a portion of the inner cylindrical surface 324*f*.

In an embodiment, the sliding sleeve 240/340, the sliding sleeve recess 224/324, or both may comprise one or more seals at one or more of the interfaces between the sliding sleeve 240/340 and the recessed bore surface 224/324. In such an embodiment, the sliding sleeve 240/340 and/or the housing 220/320 may further comprise one or more radial or concentric recesses or grooves configured to receive one or more suitable fluid seals, for example, to restrict fluid movement via the interface between one or more surfaces of the sliding sleeve 240/340 and the sliding sleeve recess 224/324. For example, in the embodiment of FIGS. 2A, 2B, and 2C, the sliding sleeve 240 comprises seals 247 substantially adjacent the lower orthogonal face 240*b* at the interface between the second outer cylindrical surface 240*f* and the second outer cylindrical surface 224*e*, and at the interface between the second inner cylindrical surface 240*h* and the inner cylindrical surface 224*f*. Similarly, in the embodiment of FIGS. 3A, 3B, and 3C, the sliding sleeve 340 comprises seals 347 substantially adjacent the lower orthogonal face 340*b* at the interface between the second outer cylindrical surface 340*f* and the second outer cylindrical surface 324*e*, and at the interface between the second inner cylindrical surface 340*h* and the inner cylindrical surface 324*f*. Additionally or alternatively, a seal may be suitably provided at the interface between any two surfaces. Suitable seals include but are not limited to a T-seal, an O-ring, a gasket, or combinations thereof.

In an embodiment, a sliding sleeve may be configured to allow or disallow fluid communication between the axial flowbore 221 of the housing and the exterior of the housing, dependent upon the position of the sliding sleeve relative to the housing. For example, in the embodiment of FIG. 2A, when the sliding sleeve 240 is in the first position, the sliding sleeve 240 obstructs the ports 225 of the housing 220 and, thereby, restricts fluid communication via the ports 225. In the embodiment of FIG. 2C, when the sliding sleeve 240 is in the second position, the sliding sleeve 240 does not obstruct the ports 225 of the housing and, thereby allows fluid communication via the ports 225.

Additionally or alternatively, in an embodiment, a sliding sleeve comprises one or more ports suitable for the communication of fluid from the axial flowbore of the housing to an exterior of the housing when so-configured. For example, in the embodiment of FIGS. 3A, 3B, and 3C, the sliding sleeve 340 further comprises ports 345. In the embodiment of FIG. 3A, where the sliding sleeve is in the first position, the ports 345 within the sliding sleeve 340 are misaligned with the ports 325 of the housing and will not communicate fluid from the axial flowbore 321 to the exterior of the housing. In the embodiment of FIG. 3C, where the sliding sleeve 340 is in the second position, the ports 345 within the second sliding sleeve 340 are aligned with the ports 325 of the housing 320 and will communicate fluid from the axial flowbore 321 to the exterior of the housing.

In an embodiment, the sliding sleeve 240/340 may be slidably movable between a first position and a second position with respect to the housing 220/320. Referring again to FIGS. 2A and 3A, the sliding sleeves 240 and 340 are shown in the first position. In the embodiment of FIG. 2A, where the sliding sleeve 240 is in the first position, the upper shoulder 240*a* of the sliding sleeve 240 may abut and/or be located substantially adjacent to the upper shoulder 224*a* of the sliding sleeve recess 224. Similarly, in the embodiment of FIG. 3A, where the sliding sleeve 340 is in the first position, the upper shoulder 340*a* of the sliding sleeve 340 may abut and/or be located substantially adjacent to the upper shoulder 324*a* of the sliding sleeve recess 324. When the sliding sleeve 240/340 is in the first position, the sliding sleeve 240/340 may be characterized as in its uppermost position relative to the housing 220/320. Referring to FIGS. 2B and 3B, the sliding sleeve 240/340 is shown in transition from the first position to the second position, as will be disclosed herein. Referring again to FIGS. 2C and 3C, the sliding sleeve 240/340 is shown in the second position. In the embodiment of FIG. 2C, where the sliding sleeve 240 is in the second position, the outer shoulder 240*c* of the sliding sleeve 240 may abut and/or be located substantially adjacent to the second shoulder 224*b* of the sliding sleeve recess 224 and the inner shoulder 240*d* may abut and/or be located substantially adjacent to the fourth shoulder 224*g*. In the embodiment of FIG. 3C, where the sliding sleeve 340 is in the second position, the inner shoulder 340*d* may abut and/or be located substantially adjacent to the fourth shoulder 324*g*. When the sliding sleeve 240/340 is in the second position, the sliding sleeve 240/340 may be characterized as in its lower-most position relative to the housing 220/320.

In an embodiment, the sliding sleeve 240 and/or 340 may be held in the second position by suitable retaining mechanism. For example, in an embodiment, the sliding sleeve may be retained in the second position by a snap-ring, alternatively, by a C-ring, a biased pin, ratchet teeth, or combinations thereof. In such an embodiment, the snap-ring (or the like) may be carried in a suitable slot, groove, channel, bore, or recess in the sliding sleeve, alternatively, in the housing, and may expand into and be received by a suitable slot groove, channel, bore, or recess in the housing, or, alternatively, in the sliding sleeve.

In an embodiment, the sliding sleeve 240/340 may be configured to allow or disallow fluid communication between the axial flowbore 221/321 of the housing 220/320 and the exterior of the housing 220/320, dependent upon the position of the sliding sleeve 240/340 relative to the housing 220/320. For example, in the embodiment of FIG. 2A, when the sliding sleeve 240 is in the first position, the sliding sleeve 240 obstructs the ports 225 of the housing 220 and, thereby, restricts fluid communication via the ports 225. In the embodiment of FIG. 2C, when the sliding sleeve 240 is in the second position, the sliding sleeve 240 does not obstruct the ports 225 of the housing 220 and, thereby allows fluid communication via the ports 225.

Additionally or alternatively, in the embodiment of FIGS. 3A, 3B, and 3C, the sliding sleeve 340 comprises one or more ports 345 suitable for the communication of fluid from the axial flowbore 321 of the housing 320 to an exterior of the housing when so-configured. For example, in the embodiment of FIG. 3A, where the sliding sleeve 340 is in the first position, the ports 345 within the sliding sleeve 340 are misaligned with the ports 325 of the housing 320 and will not communicate fluid from the axial flowbore 321 to the exterior of the housing 320. In the embodiment of FIG. 3C, where the sliding sleeve 340 is in the second position, the ports 345 within the sliding sleeve are aligned with the ports 325 of the housing and will communicate fluid from the axial flowbore 321 to the exterior of the housing 320.

In an embodiment, the sliding sleeve 240/340 may be biased in the direction of the second position, for example, such that the sliding sleeve 240/340 will move in the direction of the second position if not otherwise retained and/or if not inhibited from such movement (for example, by the fluid delay system, as will be disclosed herein). For example, in the embodiment of FIGS. 2A, 2B, and 2C, the sliding sleeve 240 is hydraulically biased. In the embodiment of FIGS. 2A, 2B, and 2C, the sliding sleeve 240, the upward-facing surfaces of the sliding sleeve 240 that are exposed to the axial flowbore 221 (e.g., upper orthogonal surface 240*a*) has a greater surface area that the downward-facing surfaces of the sliding sleeve 240 that are exposed to the axial flowbore 221 (e.g., shoulder 240*d*). As such, the application of a hydraulic pressure to the axial flowbore 221 may exert a force on the sliding sleeve 220 in the direction of the second position. Alternatively, in the embodiment of FIGS. 3A, 3B, and 3C, the sliding sleeve 340 is mechanically biased. In the embodiment of FIGS. 3A, 3B, and 3C, the ASA 300 comprises a biasing member 350 (illustrated as a coiled spring). Suitable examples of such a biasing member include, but are not limited to, a spring, a pneumatic device, a compressed fluid device, or combinations thereof. In the embodiment of FIGS. 3A, 3B, and 3C, the biasing member 350 may be configured to exert a force on the sliding sleeve 320 in the direction of the second position.

In an embodiment, the fluid delay system 260/360 generally comprises a fluid reservoir, an actuatable valve assembly (AVA), and a fluid selectively retained within the fluid reservoir by the AVA.

In the embodiment, the housing and the sliding sleeve may cooperatively define a fluid reservoir. For example, in the embodiment of FIGS. 2A, 2B, and 2C, the fluid reservoir 262 is generally defined by the second outer cylindrical surface 224*e*, the third shoulder 224*d*, and the inner cylindrical surface 224*f* of the sliding sleeve recess 224 and by the lower orthogonal face 240*b* of the sliding sleeve 240. Similarly, in the embodiment of FIGS. 3A, 3B, and 3C, the fluid reservoir 362 is generally defined by second outer cylindrical surface 324*e*, the third shoulder 324*d*, and the inner cylindrical surface 324*f* of the sliding sleeve recess 324 and by the lower orthogonal face 340*b* of the sliding sleeve 340.

In an embodiment, the fluid reservoir may be characterized as having variable volume dependent upon the position of the sliding sleeve relative to the housing. For example, referring to FIGS. 2A and 3A, where the sliding sleeve 240/340 is in the first position, the fluid reservoir 262/362 may be characterized as having the relatively greatest (e.g., an increased) volume. Alternatively, referring to FIGS. 2C and 3C, where the sliding sleeve 240/340 is in the second position, the fluid reservoir 262/362 may be characterized as having the relatively least (e.g., a decreased, minimal, or substantially empty or void) volume. For example, in an embodiment the volume of the fluid reservoir 262/362 may decrease as the sliding sleeve 240/340 moves from the first position (e.g., as illustrated in FIGS. 2A and 3A) in the direction of the second position (e.g., as illustrated in FIGS. 2C and 3C).

In an embodiment, the fluid chamber may be of any suitable size, as will be appreciated by one of skill in the art viewing this disclosure. For example, in an embodiment, a fluid chamber like fluid reservoir 262 or fluid reservoir 362 may be sized according to the position of the ASA of which it is a part in relation to one or more other, similar ASAs. For example, in an embodiment, the furthest uphole of ASA may comprise a fluid reservoir of a first volume (e.g., the relatively largest volume), the second furthest uphole ASA may comprise a fluid reservoir of a second volume (e.g., the second relatively largest volume), the third furthest uphole ASA may comprise a fluid reservoir of a third volume (e.g., the third relatively largest volume), etc. For example, the first volume may be greater than the second volume and the second volume may be greater than the third volume.

Figure 4:
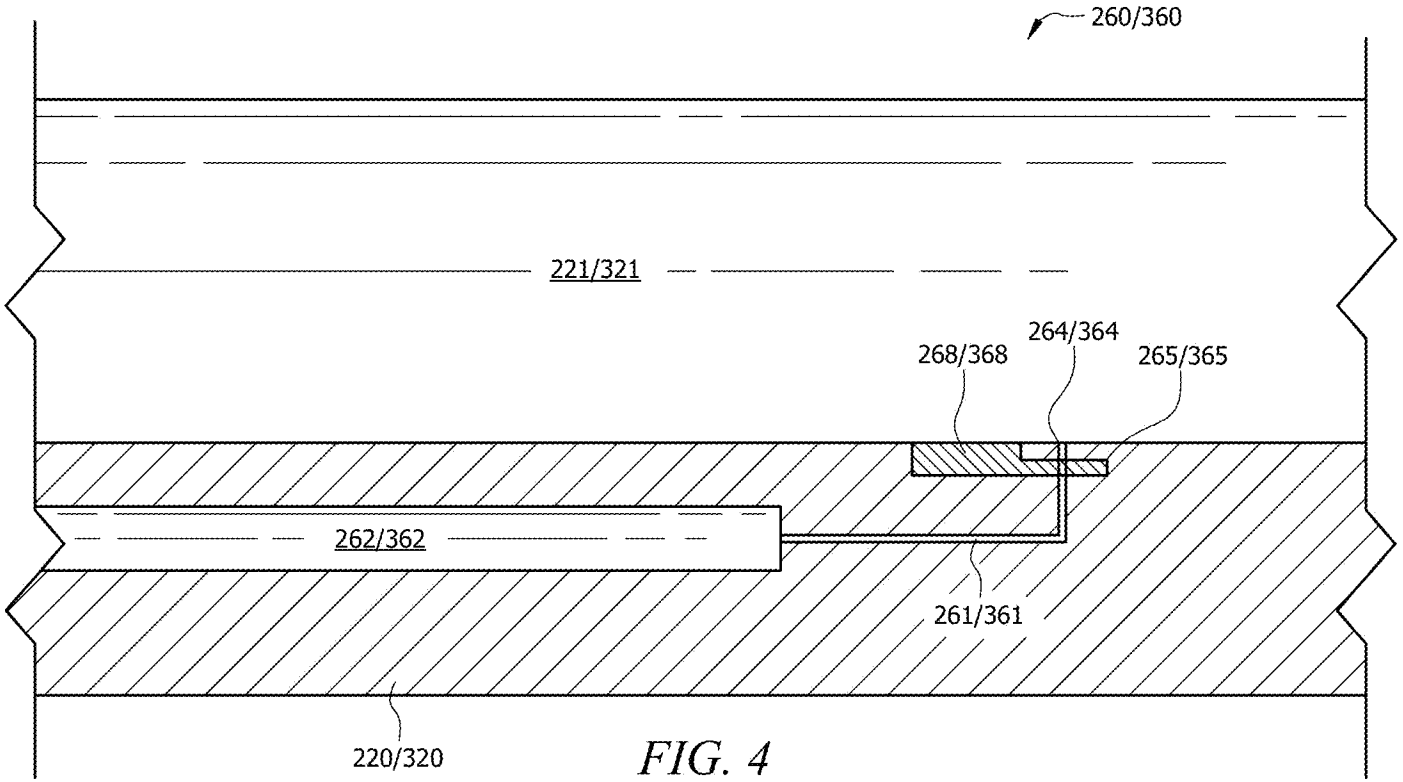
FIG. 4 is a cross-sectional view of an embodiment of a fluid delay system.

In an embodiment, the AVA generally comprises one or more devices, assemblies, or combinations thereof, configured to selectively allow the fluid either, to be retained or to escape from the fluid reservoir. Referring to FIG. 4, an embodiment of an AVA, such as the AVA disclosed with respect to FIGS. 2A-2C and 3A-3C, is illustrated. In the embodiment of FIG. 4, the AVA generally comprises a valve 265 or 365, respectively, in fluid communication with the fluid reservoir 262/362.

In an embodiment of FIG. 4, the valve 265/365 comprises a suitable type or configuration of valve. Examples of suitable types or configurations of such a valve include, but are not limited to, a ball valve, a butterfly valve, a disc valve, a check valve, a gate valve, a knife valve, a piston valve, a spool valve, or combinations thereof. In an embodiment, the valve 265/365 is in fluid communication with the fluid reservoir 262/362, for example, such that opening or closing the valve 265/365 may either allow or disallow fluid communication to and/or from the fluid reservoir 262/362. For example, in the embodiment of FIG. 4, the fluid reservoir 262/362 is in fluid communication with the valve 265/365 via a flowpath 261/361 within the housing 220/320. In the embodiment of FIG. 4, the valve is configured to allow fluid communication between the fluid reservoir 262/362 and the axial flowbore 221/321 (when the AVA is so-configured). In an additional or alternative embodiment, a valve may be configured to allow fluid communication between the fluid reservoir and a secondary fluid chamber, to an exterior of the housing (e.g., an annular space, or combinations thereof.

In an embodiment, the valve 265/365 may be selectively actuatable responsive to a signal. For example, in the embodiment of FIG. 4, the AVA further comprises a signal receiver 268/368 configured to receive a suitable signal from a signaling member (e.g., as will be disclosed herein) and, responsive to receipt of the signal, to selectively actuate (e.g., open or close) the valve 265/365. Examples of suitable signals include a wireless signal, electric signal, electronic signal, acoustic signal, a magnetic signal, an electromagnectic signal, a chemical signal, a radioactivity signal, or combinations thereof. In such an embodiment, the signal receiver 268/368 may comprise any suitable type or configuration of signal receiver, for example, a wireless receiver, an electric receiver, an electronic receiver, an acoustic receiver, a magnetic receiver, an electromagnetic receiver, or combinations thereof. In an embodiment, the signal receiver 268/368 may be configured to receive such a signal when a signaling member comes within a given proximity of the signal receiver 268/368. For example, the signal receiver 268/368 may detect the signaling member within a desired range (e.g., within about 1 inches, alternatively, within about 1 foot, alternatively, within about 5 feet, alternatively, within about 10 feet, alternatively, within about 20 feet). In an embodiment, upon receipt of a signal, the signal receiver 268/368 may be configured to actuate or drive the valve 265/365, thereby opening or closing the valve 265/365. For example, in such an embodiment, the valve 265/365 may be actuated (e.g., opened or closed) by any suitable motive or force. For example, such a valve may be actuatable hydraulically, pneumatically, solenoid, electrically, or combinations thereof. In an embodiment, the signal receiver may comprise an interrogation unit, for example, capable of sensing a suitable signal within a given proximity. Additionally or alternatively, the signal receiver may comprise a communication unit, for example, capable of communicating a suitable signal, for example, which may be in response to interrogation such as by an interrogation unit. Interrogation and communication unit are disclosed in U.S. application Ser. No. 13/031,513 to Roddy, et al., which is incorporated herein by reference in its entirety.

In an additional embodiment, the AVA, the signal receiver 268/368, the valve 265/365, or combinations thereof, may further comprise a power source (e.g., a battery), a power generation device, or combinations thereof. In such an embodiment, the power source and/or power generation device may supply power to the AVA, the signal receiver 268/368, the valve 265/365, or combinations thereof, for example, for the purpose of operating the signal receiver 268/368, operating the valve 265/365, or combinations thereof. In an embodiment, such a power generation device may comprise a generator, such as a turbo-generator configured to convert fluid movement into electrical power; alternatively, a thermoelectric generator, which may be configured to convert differences in temperature into electrical power. In such embodiments, such a power generation device may be carried with, attached, incorporated within or otherwise suitable coupled to an ASA and/or a component thereof. Suitable power generation devices, such as a turbo-generator and a thermoelectric generator are disclosed in U.S. Pat. No. 8,162,050 to Roddy, et al., which is incorporated herein by reference in its entirety. An example of a power source and/or a power generation device is a Galvanic Cell. In an embodiment, the power source and/or power generation device may be sufficient to power actuation of the AVA, for example, in the range of from about 0.5 to about 10 watts, alternatively, from about 0.5 to about 1.0 watt.

In an embodiment, the AVA may be configured to allow the fluid to escape from the fluid reservoir 262/362 at a controlled and/or predetermined rate. For example, in the embodiment of FIG. 4, AVA comprises an orifice 264/364. In various embodiments, the orifice 264/364 may be sized and/or otherwise configured to communicate a fluid of a given character at a given rate. As may be appreciated by one of skill in the art, the rate at which a fluid is communicated via the orifice 264/364 may be at least partially dependent upon the viscosity of the fluid, the temperature of the fluid, the pressure of the fluid, the presence or absence of particulate material in the fluid, the flow-rate of the fluid, or combinations thereof. In an embodiment, an orifice like orifice 264/364 may be fitted with nozzles or erodible fittings, for example, such that the flow rate at which fluid is communicated via such an orifice varies over time. In an embodiment, an orifice like orifice 264/364 may be fitted with screens of a given size, for example, to restrict particulate flow through (e.g., into) the orifice 264/364.

In an additional embodiment, an orifice like orifice 264/364 may be sized according to the position of the ASA of which it is a part in relation to one or more other similar orifices of other ASAs. For example, in an ASA cluster comprising multiple ASAs, the furthest uphole of these ASA may comprise an orifice sized to allow a first flow-rate (e.g., the relatively slowest flow-rate), the second furthest uphole ASA may comprise an orifice sized to allow a second flow-rate (e.g., the second relatively slowest flow-rate), the third furthest uphole ASA may comprise an orifice sized to allow a third flow-rate (e.g., the third relatively slowest flow-rate), etc. For example, the first flow-rate may be less than the second flow-rate and the second flow-rate may be less than the third flow-rate. In an embodiment, an orifice like orifice 264/364 may further comprise a fluid metering device received at least partially therein. In such an embodiment, the fluid metering device may comprise a fluid restrictor, for example a precision microhydraulics fluid restrictor or micro-dispensing valve of the type produced by The Lee Company of Westbrook, Conn. However, it will be appreciated that in alternative embodiments any other suitable fluid metering device may be used. For example, any suitable electro-fluid device may be used to selectively pump and/or restrict passage of fluid through the device (e.g., a micro-pump, configured to displace fluid from reservoir 262/362 to reduce the amount of fluid therein).

In an embodiment, the wellbore servicing system 100 further comprises a signaling member. In such an embodiment, the signaling member generally comprises any suitable device capable of sending, emitting, or returning a signal capable of being received by the signal receiver 268/368, as disclosed herein. In various embodiments, the signaling member may generally be characterized as an active signaling device, for example, a device to actively emits a given signal. Alternatively, the signaling member may generally be characterized as a passive signaling device, for example, a device that, by its presence, allows a signal to be evoked. For example, suitable signaling members may include, but are not limited to, radio-frequency identification (RFID) tags, radio transmitters, microelectromechanical systems (MEMS), a magnetic device, acoustic signal transmitting devices, radiation and/or radioactivity-emitters, magnetic or electromagnetic emitters, the like or combinations thereof. In various embodiments, the signaling member may be configured suitably for communication into a wellbore. For example, in an embodiment, a signaling member may be configured as a ball, a dart, a tag, a chip, or the like that may be conveyed (e.g., pumped) through the wellbore to a given ASA with which the signal receiver 268/368 is associated. As similarly noted above, the signaling member may comprise an interrogation unit, a communication unit, or combinations thereof.

In an embodiment, for example, referring again to FIG. 1, in an embodiment wherein the wellbore servicing system comprises a plurality of ASAs as disclosed herein (e.g., a first ASA 200A, a second ASA 200B, a third ASA 200C, a fourth ASA 200D, a fifth ASA 200E, and a sixth ASA 200F), a given signaling member may send, emit, or return a signal to any one or more of the plurality ASAs. In such an embodiment, a given signaling member may be specific to one or more of the plurality of AVAs associated with the plurality of ASAs. For example, a given signaling member may be configured to thereby actuate (e.g., open or close) a given one or more of the plurality of AVAs associated with the plurality of ASAs. Similarly, a given signaling member may be configured to not actuate (e.g., open or close) a given one or more of the plurality of AVAs associated with the plurality of ASAs.

In an embodiment, the fluid reservoir 262/362 may be filled, substantially filled, or partially filled with a suitable fluid. In an embodiment, the fluid may be characterized as having a suitable rheology. In an embodiment, the fluid may be characterized as substantially incompressible. In an embodiment, the fluid may be characterized as having a suitable bulk modulus, for example, a relatively high bulk modulus. For example, in an embodiment, the fluid may be characterized as having a bulk modulus in the range of from about 1.8 $10^5$ psi, $lb_f/in^2$ to about 2.8 $10^5$ psi, $lb_f/in^2$ from about 1.9 $10^5$ psi, $lb_f/in^2$ to about 2.6 $10^5$ psi, $lb_f/in^2$, alternatively, from about 2.0 $10^5$ psi, $lb_f/in^2$ to about 2.4 $10^5$ psi, $lb_f/in^2$. In an additional embodiment, the fluid may be characterized as having a relatively low coefficient of thermal expansion. For example, in an embodiment, the fluid may be characterized as having a coefficient of thermal expansion in the range of from about 0.0004 cc/cc/° C. to about 0.0015 cc/cc/° C., alternatively, from about 0.0006 cc/cc/° C. to about 0.0013 cc/cc/° C., alternatively, from about 0.0007 cc/cc/° C. to about 0.0011 cc/cc/° C. In another additional embodiment, the fluid may be characterized as having a stable fluid viscosity across a relatively wide temperature range (e.g., a working range), for example, across a temperature range from about 50° F. to about 400° F., alternatively, from about 60° F. to about 350° F., alternatively, from about 70° F. to about 300° F. In another embodiment, the fluid may be characterized as having a viscosity in the range of from about 50 centistokes to about 500 centistokes. Examples of a suitable fluid include, but are not limited to oils, such as synthetic fluids, hydrocarbons, or combinations thereof. Particular examples of a suitable fluid include silicon oil, paraffin oil, petroleum-based oils, brake fluid (glycol-ether-based fluids, mineral-based oils, and/or silicon-based fluids), transmission fluid, synthetic fluids, or combinations thereof.

In an embodiment, the fluid delay system 260/360 may be effective to retain the sliding sleeve 240/340 in the first position and to allow movement of the sliding sleeve 240/

340 from the first position to the second position at a controlled rate (e.g., over a desired period of time). For example, referring to FIGS. 2A and 3A, in an embodiment the fluid may be retained in the fluid reservoir 262/362 by the AVA when the AVA is so-configured (e.g., when the valve 265/365 or closed), thereby inhibiting movement of the sliding sleeve 240/340 in the direction of the second position. Also, referring to FIGS. 2B and 2C and to FIGS. 3B and 3C, the fluid may be allowed to escape from the fluid reservoir 262/362 (e.g., at a controlled, predetermined rate) when the AVA is so-configured (e.g., when the valve 265/365 is open), thereby allowing movement of the sliding sleeve 240/340 in the direction of the second position.

One or more embodiments of an ASA 200 and a wellbore servicing system 100 comprising one or more ASAs like ASA 200 or ASA 300 (e.g., ASAs 200A-200F) having been disclosed, one or more embodiments of a wellbore servicing method employing such a wellbore servicing system 100 and/or such an ASA 200/300 are also disclosed herein. In an embodiment, a wellbore servicing method may generally comprise the steps of positioning a wellbore servicing system comprising one or more ASAs within a wellbore such that each of the ASAs is proximate to a zone of a subterranean formation, optionally, isolating adjacent zones of the subterranean formation, transitioning the sliding sleeve within an ASA from its first position to its second position, and communicating a servicing fluid to the zone proximate to the ASA via the ASA.

In an embodiment, the process of transitioning a sliding sleeve within an ASA from its first position to its second position and communicating a servicing fluid to the zone proximate to the ASA via that ASA, as will be disclosed herein, may be performed, for as many ASAs as may be incorporated within the wellbore servicing system or some portion thereof.

In an embodiment, one or more ASAs may be incorporated within a work string or casing string, for example, like casing string 120, and may be positioned within a wellbore like wellbore 114. For example, in the embodiment of FIG. 1, the liner 118 has incorporated therein the first ASA 200A, the second ASA 200B, the third ASA 200C, the fourth ASA 200D, the fifth ASA 200E, and the sixth ASA 200F. Also in the embodiment of FIG. 1, the liner 118 is positioned within the wellbore 114 such that the first ASA 200A is proximate and/or substantially adjacent to the first subterranean formation zone 2, the second ASA 200B is proximate and/or substantially adjacent to the second zone 4, the third ASA 200C is proximate and/or substantially adjacent to the third zone 6, the fourth ASA 200D is proximate and/or substantially adjacent to the fourth zone 8, the fifth ASA 200E is proximate and/or substantially adjacent to the fifth zone 10, and the sixth ASA 200F is proximate and/or substantially adjacent to the sixth zone 12. Alternatively, any suitable number of ASAs may be incorporated within a liner, a casing string, or the like. In an embodiment, the ASAs (e.g., ASAs 200A-200F) may be positioned within the wellbore 114 in a configuration in which no ASA will communicate fluid to the subterranean formation, particularly, the ASAs may be positioned within the wellbore 114 in the first, run-in, or installation mode or configuration, for example, such that the sliding sleeve is retained in its first position and such that the ASA will not communicate a fluid via its ports, as disclosed herein with regard to ASA 200 and/or ASA 300.

In an embodiment, once the liner 118 comprising the ASAs (e.g., ASAs 200*a*-200*c*) has been positioned within the wellbore 114, adjacent zones may be isolated and/or the liner 118 may be secured within the formation. For example, in the embodiment of FIG. 1, the first zone 2 may be isolated from the second zone 4, the second zone 4 from the third zone 6, the third zone 6 from the fourth zone 8, the fourth zone 8 from the fifth zone 10, the fifth zone from the sixth zone, or combinations thereof. In the embodiment of FIG. 1, the adjacent zones (e.g., 2, 4, 6, 8, 10, and/or 12) are separated by one or more suitable wellbore isolation devices 130. Suitable wellbore isolation devices 130 are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof. In an alternative embodiment, only a portion of the zones (e.g., 2, 4, 6, 8, 10, and/or 12) may be isolated, alternatively, the zones may remain unisolated. Additionally and/or alternatively, the liner 118 may be secured within the formation, as noted above, for example, by cementing.

In an embodiment, the zones of the subterranean formation (e.g., 2, 4, 6, 8, 10, and/or 12) may be serviced working from the zone that is furthest down-hole (e.g., in the embodiment of FIG. 1, the first formation zone 2) progressively upward toward the furthest up-hole zone (e.g., in the embodiment of FIG. 1, the sixth formation zone 12). In alternative embodiments, the zones of the subterranean formation may be serviced in any suitable order. As will be appreciated by one of skill in the art, upon viewing this disclosure, the order in which the zones are serviced may be dependent upon, or at least influenced by, the method of activation chosen for each of the ASAs associated with each of these zones.

In an embodiment where the wellbore is serviced working from the furthest down-hole formation zone progressively upward, once the liner (or other suitable string) comprising the ASAs has been positioned within the wellbore and, optionally, once adjacent zones of the subterranean formation (e.g., 2, 4, 6, 8, 10, and/or 12) have been isolated, the first ASA 200A may be prepared for the communication of a fluid to the proximate and/or adjacent zone. In such an embodiment, the sliding sleeve 240 or 340 within the ASA (e.g., ASA 200A) proximate and/or substantially adjacent to the first zone to be serviced (e.g., formation zone 2), is transitioned from its first position to its second position. In an embodiment, transitioning the sliding sleeve 240 or 340 within the ASA 200 or 300 to its second position may comprise introducing a signaling member (e.g., a ball or dart) configured to send a signal that ASA 200/300 (e.g., ASA 200A) into the liner 118 and forward-circulating (e.g., pumping) the signaling member into sufficient proximity with the ASA 200/300 (e.g., ASA 200A), particularly, the signal receiver 268/368 of the ASA 200/300 so as to cause the valve 265/365 to be actuated (e.g., opened). In an embodiment, the signaling member may be effective to actuate (e.g., open) the valve of only one of the ASAs (e.g., ASA 200A), for example, via a matching signal type or identifier between a given one or more ASAs and a given signaling member. In such an embodiment, the signaling member may be communicated via the axial flowbore of one or more other ASAs (e.g., ASAs 200B-200F) en route to the intended ASA (e.g., ASA 200A) without altering the mode or configuration of such other ASAs. In an alternative embodiment, the signaling member may be effective to actuate (e.g., open) the valve of multiple of the ASAs (e.g., ASA 200A and ASA 200B, or others). In such an embodiment, the signaling member may actuate (e.g., open) the valve of multiple ASAs when communicated via the axial flowbore of such ASAs.

In the embodiment of FIGS. 2A, 2B, and 2C, as noted above, the application of a fluid pressure to the axial flowbore 221 may result in a net force applied to the sliding sleeve 240 in the direction of the second position. Similarly, in the embodiment of FIGS. 3A, 3B, and 3C, the biasing member 350 applies force to the sliding sleeve 340 in the direction of the second position. In an embodiment, when the valve 265/365 has been actuated (e.g., opened), thereby transitioning the ASA from the first mode to the second mode, the fluid within the fluid reservoir may be free to escape therefrom, thereby allowing the forces applied to the sliding sleeve 240/340 to move the sliding sleeve 240/340 in the direction of its second position as the fluid escapes from the fluid reservoir 262/362, for example, as illustrated by flow arrow f in the embodiments of FIGS. 2B and 3B.

As fluid escapes from the fluid reservoir 262/362, the sliding sleeve 240/340 is allowed to continue to move toward the second position. As such, the rate at which the sliding sleeve 240/340 may move from the first position to the second position is at least partially dependent upon the rate at which fluid is allowed to escape and/or dissipate from the fluid reservoir 262/362 via orifice 264/365. For example, because the rate at which the sliding sleeve transitions from the first position to the second position may be controlled, as disclosed herein, the time duration necessary to transition the from the first position to the second position may be varied.

For example, in an embodiment, the ASA 200A (e.g., like ASA 200 or ASA 300) may be configured such that the sliding sleeve 240/340 will transition from the first position to the second position at a rate such that the ports 225/325 remain obscured (e.g., from fluid communication) for a predetermined, desired amount of time (e.g., beginning upon being transitioned from the first mode or configuration to the second mode or configuration by actuation of the valve 265/365). For example, the duration of time may depend upon the rate at which the fluid is emitted from the fluid reservoir, the volume of fluid within the fluid reservoir, the volume of the fluid reservoir, the force applied to the fluid reservoir, or combinations thereof. In an embodiment, an ASA may be configured to fully transition to from the first mode to the third mode (e.g., the fully-open mode) within a predetermined, desired time range, for example, about 15 minutes, alternatively, about 30 minutes, alternatively about 45 minutes, alternatively, about 1 hour, alternatively, about 1.5 hours, alternatively, about 2 hours, alternatively, about 2.5 hours, alternatively, about 3 hours, alternatively, about 3.5 hours, alternatively, about 4 hours, alternatively, about 5 hours, alternatively, any other suitable duration of time. In an embodiment where multiple ASAs are transitioned from the first mode to the second mode by a common signaling member, the ASAs may be configured such that no ASA will transition from the second mode to the third mode until all ASAs intended to be transitioned from the first mode to the second mode by that signaling member have been transitioned from the first mode to the second mode.

For example, with reference to the embodiment of FIG. 1, the ASAs (e.g., ASAs 200A, 200B, 200C, 200D, 200E, and 200F) may be configured to open in any suitable order so as to allow the zone and/or zones associated therewith to be serviced in any suitable order and/or combination. For example, in an embodiment, the order in which two or more ASAs are configured to open may be dependent upon whether a given ASA is transitioned from the first mode to the second mode by a given signaling member (e.g., whether a given signaling member is effective to actuate the valve 265/365), the duration necessary to transition an ASA from the second mode to the third mode (e.g., the time necessary for the ports 225/325 to become unobscured by the sliding sleeve 240/340, for example, as controlled by the fluid delay system, 260/360), or combinations thereof.

In an embodiment, the ASAs may be configured to open so as to allow fluid access first to zone 2, then zone 4, then zone 6, then zone 8, the zone 10, and then zone 12. Alternatively, other orderings may also be possible, for example, 12-10-8-6-4-2; alternatively, 2-6-4-10-8-12; alternatively, 2-6-10-4-8-12; alternatively, 2-6-10-12-8-4; alternatively, 10-6-2-4-8-12; alternatively, 10-6-2-12-8-4; or portions or combinations thereof. In addition, as noted herein, two or more zones may be treated simultaneously and/or substantially simultaneously, for example, by configured two or more ASAs to allow fluid access to the formation simultaneously or substantially simultaneously. As disclosed herein, one or more of such orders may be achieved dependent upon whether a given ASA is transitioned from the first mode to the second mode by a given signaling member and/or dependent upon the duration necessary to transition an ASA from the second mode to the third mode. As may be appreciated by one of skill in the art upon viewing this disclosure, in an embodiment where it is desired to inhibit fluid communication to a zone that has previously been treated (e.g., stimulated, such as by fracturing), fluid communication may be inhibited (e.g., the zone may be isolated) by setting a mechanical plug (e.g., a fracturing or bridge plug) or a particulate plug (e.g., a sand plug, a proppant plug, and/or temporary plug, such as a degradable/dissolvable plug).

In an embodiment, the sliding sleeve 240/340 may continue to move in the direction of its second position until reaching the second position, thereby transitioning the ASA from the second mode into the third mode, as illustrated in the embodiments of FIGS. 2C and 3C. In an embodiment, as the sliding sleeve 240/340 moves from the first position to the second position, the sliding sleeve 240/340 ceases to obscure the ports 225/325 within the housing 220/320.

In an embodiment, when the first ASA 200A is configured for the communication of a servicing fluid, for example, when the first ASA 200A has transitioned to the fully-open mode, as disclosed herein, a suitable wellbore servicing fluid may be communicated to the first subterranean formation zone 2 via the unobscured ports 225/325 of the first ASA 200A. Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation 102 and/or a zone thereof.

In an embodiment, when a desired amount of the servicing fluid has been communicated to the first formation zone 2, an operator may cease the communication of fluid to the first formation zone 2. Optionally, the treated zone may be isolated, for example, via a mechanical plug, sand plug, or the like, placed within the flowbore between two zones (e.g., between the first and second zones, 2 and 4). The process of transitioning a sliding sleeve within an ASA from its first position to its second position and communicating a servicing fluid to the zone proximate to the ASA via that ASA may be repeated with respect the second, third, fourth, fifth, and sixth ASAs, 200B, 200C, 200D, 200E, and 200F, respectively, and the formation zones 4, 6, 8, 10, and 12, associated therewith. Additionally, in an embodiment where additional zones are present, the process may be repeated for any one or more of the additional zones and the associated ASAs.

In an embodiment, an ASA such as ASA 200 or 300, a wellbore servicing system such as wellbore servicing system 100 comprising an ASA such as ASA 200/300, a wellbore servicing method employing such a wellbore servicing system 100 and/or such an ASA 200/300, or combinations thereof may be advantageously employed in the performance of a wellbore servicing operation. For example, conventional wellbore servicing tools have utilized ball seats, baffles, or similar structures configured to engage an obturating member (e.g., a ball or dart) in order to actuate such a servicing tool. In an embodiment, an ASA may be characterized as having no reductions in diameter, alternatively, substantially no reductions in diameter, of a flowbore extending therethrough. For example, an ASA, such as ASA 200 or ASA 300 may be characterized as having a flowbore (e.g., flowbore 221 or 321) having an internal diameter that, at no point, is substantially narrower than the flowbore of a tubing string in which that ASA is incorporated (e.g., the diameter of the axial flowbore 117 of the liner 118); alternatively, a diameter, at no point, that is less than 95% of the diameter of the tubing string; alternatively, not less than 90% of the diameter; alternatively, not less than 85% of the diameter; alternatively, not less than 80% of the diameter. However, such structures configured to receive and/or engage an obturating member are subject to failure by erosion and/or degradation due to exposure to servicing fluids (e.g., proppant-laden, fracturing fluids) and, thus, may fail to operate as intended. In the embodiments disclosed herein, no such structure is present. As such, the instantly disclosed ASAs are not subject to failure due to the inoperability of such a structure. Further, the absence of such structure allows improved fluid flow through the ASAs as disclosed herein, for example, because no such structures are present to impede fluid flow.

Further, in an embodiment, the ASAs as disclosed herein, may be actuated and utilized in any order desired by the operator. For example, as will be appreciated by one of skill in the art upon viewing this disclosure, whereas conventional servicing tools utilizing ball seats, baffles, or similar structures to actuate such wellbore servicing tools, thereby necessitating that a wellbore servicing operation be performed from the bottom, working upward (e.g., toe to heel), because the signaling members disclosed herein may be configured to actuate any one or more ASAs in substantially any suitable order. As such, the instantly disclosed ASAs may afford an operator the ability to simultaneously service two or more non-adjacent zones, or to service zones in almost any order, either of which would have been virtually impossible utilizing conventional wellbore servicing tools.

Additional Disclosure

The following are nonlimiting, specific embodiments in accordance with the present disclosure:

Embodiment 1

A wellbore servicing tool comprising:

a housing at least partially defining an axial flowbore, the housing comprising one or more ports;

a sliding sleeve, the sliding sleeve being slidably positioned within the housing and transitionable from:

a first position in which the sliding prevents fluid communication via a route of fluid communication from the axial flowbore to an exterior of the housing via the one or more ports, to a second position in which the sliding sleeve allows fluid communication via the route of fluid communication from the axial flowbore to an exterior of the housing via the one or more ports; and a fluid delay system configured to retain the sliding sleeve in the first position until actuated and to allow the sliding sleeve to transition from the first position to the second position at a controlled rate when actuated, wherein the fluid delay system is actuatable via a wireless signal.

Embodiment 2

The wellbore servicing tool of embodiment 1, wherein the wireless signal comprises a radio frequency, an RFID signal, a magnetic field, an acoustic signal, or combinations thereof.

Embodiment 3

The wellbore servicing tool of one of embodiments 1 through 2, wherein the wireless signal is unique to the wellbore servicing tool.

Embodiment 4

The wellbore servicing tool of one of embodiments 1 through 3, wherein the fluid delay system comprises an actuatable valve.

Embodiment 5

The wellbore servicing tool of one of embodiments 1 through 4, wherein the fluid delay system is configured to open the actuatable valve responsive to receipt of the wireless signal.

Embodiment 6

The wellbore servicing tool of one of embodiments 1 through 5, wherein the actuatable valve is in fluid communication with a fluid reservoir.

Embodiment 7

The wellbore servicing tool of one of embodiments 1 through 6, wherein the fluid delay system comprises a signal receiver.

Embodiment 8

The wellbore servicing tool of one of embodiments 1 through 7, wherein the housing has an about constant inner diameter.

Embodiment 9

A wellbore servicing method comprising:

positioning a wellbore servicing system within a wellbore penetrating a subterranean formation, the wellbore servicing system comprising a first wellbore servicing tool, the first wellbore servicing tool comprising:

a housing at least partially defining an axial flowbore, the housing comprising one or more ports;

a sliding sleeve, the sliding sleeve being slidably positioned within the housing and transitionable from:

a first position in which the sliding sleeve obscures fluid communication via a route of fluid communication from the axial flowbore to an exterior of the housing via the one or more ports, to a second position in which the sliding allows fluid communication via the route of fluid communication from the axial flowbore to an exterior of the housing via the one or more ports; and a fluid delay system configured to retain the sliding sleeve in the first position until actuated and to allow the sliding sleeve to transition from the first position to the second position at a controlled rate when actuated;

communicating a first wireless signal to the fluid delay system of the first wellbore servicing tool, wherein receipt of the first wireless signal by the fluid delay system of the first wellbore servicing tool is effective to actuate the fluid delay system of the first wellbore servicing tool; and communicating a wellbore servicing fluid to a first zone of the subterranean formation via the one or more ports of the first wellbore servicing tool.

Embodiment 10

The wellbore servicing method of embodiment 9, wherein communicating the first wireless signal to the fluid delay system of the first wellbore servicing tool comprises flowing a first signaling member via the axial flowbore of the first wellbore servicing tool.

Embodiment 11

The wellbore servicing method of embodiment 10, wherein the first signaling member is configured to provide the first wireless signal for receipt by the fluid delay system of the first wellbore servicing tool.

Embodiment 12

The wellbore servicing method of one of embodiments 10 through 11, wherein the first wireless signal comprises a radio frequency, an RFID signal, a magnetic field, an acoustic signal, or combinations thereof.

Embodiment 13

The wellbore servicing method of one of embodiments 10 through 12, wherein the wellbore servicing system further comprises a second wellbore servicing tool, the second wellbore servicing tool comprising:

a housing at least partially defining an axial flowbore, the housing comprising a one or more ports;

a sliding sleeve, the sliding sleeve being slidably positioned within the housing and transitionable from:

a first position in which the sliding sleeve prevents fluid communication via a route of fluid communication from the axial flowbore to an exterior of the housing via the one or more ports, to a second position in which the sliding allows fluid communication via the route of fluid communication from the axial flowbore to an exterior of the housing via the one or more ports; and a fluid delay system configured to retain the sliding sleeve in the first position until actuated and to allow the sliding sleeve to transition from the first position to the second position at a controlled rate when actuated.

Embodiment 14

The wellbore servicing method of embodiment 13, further comprising:

communicating the first wireless signal to the fluid delay system of the second wellbore servicing tool, wherein receipt of the first wireless signal by the fluid delay system of the second wellbore servicing tool is effective to actuate the fluid delay system of the second wellbore servicing tool; and communicating a wellbore servicing fluid to a second zone of the subterranean formation via the one or more ports of the second wellbore servicing tool.

Embodiment 15

The wellbore servicing method of embodiment 13, further comprising:

communicating the first wireless signal to the fluid delay system of the second wellbore servicing tool, wherein receipt of the first wireless signal by the fluid delay system of the second wellbore servicing tool is not effective to actuate the fluid delay system of the second wellbore servicing tool.

Embodiment 16

The wellbore servicing method of embodiment 15, further comprising:

communicating a second wireless signal to the fluid delay system of the second wellbore servicing tool, wherein receipt of the second wireless signal by the fluid delay system of the second wellbore servicing tool is effective to actuate the fluid delay system of the second wellbore servicing tool; and communicating a wellbore servicing fluid to a second zone of the subterranean formation via the one or more ports of the second wellbore servicing tool.

Embodiment 17

The wellbore servicing method of one of embodiments 13 through 16, wherein the first wellbore servicing tool and the second wellbore servicing tool are incorporated within a tubular string, the tubular string generally defining a tubular string axial flowbore, wherein the axial flowbore of the first wellbore servicing tool, the axial flowbore of the second wellbore servicing tool, and the tubular string axial flowbore each have a internal diameter, wherein the internal diameter of the axial flowbore of the first wellbore servicing tool and the internal diameter of the axial flowbore of the second wellbore servicing tool are substantially the same as the internal diameter of the tubular string axial flowbore.

Embodiment 18

A wellbore servicing method comprising:

positioning a wellbore servicing system within a wellbore penetrating a subterranean formation, the wellbore servicing system comprising a first wellbore servicing tool, the first wellbore servicing tool being configured in a first mode and transitionable from the first mode to a second mode and from the second mode to a third mode, the first wellbore servicing tool comprising:

a housing at least partially defining an axial flowbore, the housing comprising one or more ports;

a sliding sleeve, the sliding sleeve being slidably positioned within the housing; and a fluid delay system, communicating a first wireless signal to the fluid delay system of the first wellbore servicing tool, wherein receipt of the first wireless signal by the fluid delay system of the first wellbore servicing tool is effective to transition the first wellbore servicing tool from the first mode to the second mode;

allowing the first wellbore servicing tool to transition from the second mode to the third mode; and communicating a wellbore servicing fluid to a first zone of the subterranean formation via the one or more ports of the first wellbore servicing tool.

Embodiment 19

The wellbore servicing method of embodiment 18, wherein, in the first mode, the fluid delay system is configured to hold the sliding sleeve relative the housing so as to prevent fluid communication via a route of fluid communication from the axial flowbore to an exterior of the housing via the one or more ports, wherein, in the second mode, the fluid delay system is configured to allow the sliding sleeve to move relative to the housing at a controlled rate, wherein, in the third mode, the sliding allows fluid communication via the route of fluid communication from the axial flowbore to an exterior of the housing via the one or more ports.

Embodiment 20

The wellbore servicing method of one of embodiments 18 through 19, wherein communicating the first wireless signal to the fluid delay system of the first wellbore servicing tool comprises flowing a first signaling member via the axial flowbore of the first wellbore servicing tool.

Embodiment 21

The wellbore servicing method of embodiment 20, wherein the first signaling member is configured to provide the first wireless signal for receipt by the fluid delay system of the first wellbore servicing tool.

Embodiment 22

The wellbore servicing method of one of embodiments 18 through 21, wherein the wellbore servicing system further comprises a second wellbore servicing tool, the second wellbore servicing tool being configured in a first mode and transitionable from the first mode to a second mode and from the second mode to a third mode, the second wellbore servicing tool comprising:

a housing at least partially defining an axial flowbore, the housing comprising one or more ports;

a sliding sleeve, the sliding sleeve being slidably positioned within the housing; and a fluid delay system.

Embodiment 23

The wellbore servicing method of embodiment 22, further comprising:

communicating the first wireless signal to the fluid delay system of the second wellbore servicing tool, wherein receipt of the first wireless signal by the fluid delay system of the second wellbore servicing tool is effective to transition the second wellbore servicing tool from the first mode to the second mode;

allowing the second wellbore servicing tool to transition from the second mode to the third mode; and communicating a wellbore servicing fluid to a second zone of the subterranean formation via the one or more ports of the second wellbore servicing tool.

Embodiment 24

The wellbore servicing method of embodiment 22, further comprising:

communicating the first wireless signal to the fluid delay system of the second wellbore servicing tool, wherein receipt of the first wireless signal by the fluid delay system of the second wellbore servicing tool is not effective to transition the second wellbore servicing tool from the first mode to the second mode.

Embodiment 25

The wellbore servicing method of embodiment 24, further comprising:

communicating the second wireless signal to the fluid delay system of the second wellbore servicing tool, wherein receipt of the second wireless signal by the fluid delay system of the second wellbore servicing tool is effective to transition the second wellbore servicing tool from the first mode to the second mode;

allowing the second wellbore servicing tool to transition from the second mode to the third mode; and communicating a wellbore servicing fluid to a second zone of the subterranean formation via the one or more ports of the second wellbore servicing tool.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A wellbore servicing tool comprising:

a housing at least partially defining an axial flowbore, the housing comprising one or more ports;

a sliding sleeve recess, the sliding sleeve recess comprising a passageway, a first shoulder, a second shoulder, a third shoulder, a fourth shoulder, a first outer surface extending between the first shoulder and the second shoulder, a second outer surface extending between the second shoulder and the third shoulder, an inner surface extending at least partially over the second outer surface and terminating at the fourth shoulder thereby at least partially defining an annular space between the second outer surface and the inner surface, and wherein the housing comprises the sliding sleeve recess;

a sliding sleeve oriented within the sliding sleeve recess, the sliding sleeve comprising a first upper shoulder and a first outer shoulder, the sliding sleeve being slidably positioned within the housing so as to define a fluid reservoir, wherein the sliding sleeve is transitionable from:

a first position in which the sliding sleeve prevents fluid communication via a route of fluid communication from the axial flowbore to an exterior of the housing via the one or more ports and the first upper shoulder is adjacent to the first shoulder, to a second position in which the sliding sleeve allows fluid communication via the route of fluid communication from the axial flowbore to the exterior of the housing via the one or more ports and the first outer shoulder is adjacent to the second shoulder, wherein the sliding sleeve is biased toward the second position by a biasing member;

a fluid delay system comprising:

an actuatable valve in fluid communication with the fluid reservoir, wherein the actuatable valve is configured to selectively retain a fluid within the fluid reservoir, wherein when the fluid is retained within the fluid reservoir, the sliding sleeve is retained in the first position and, when the fluid is not retained within the fluid reservoir, the sliding sleeve is allowed to transition from the first position to the second position at a controlled rate;

a signal receiver configured to receive a wireless signal from a signaling member, wherein the actuatable valve is actuatable via the wireless signal; and wherein the inner diameter of the wellbore servicing tool is not narrower than the internal diameter of the axial flowbore.

2. The wellbore servicing tool of claim 1, wherein the wireless signal comprises a radio frequency, an RFID signal, a magnetic field, an acoustic signal, a radioactivity signal or combinations thereof.

3. The wellbore servicing tool of claim 1, wherein the wireless signal is unique to the wellbore servicing tool.

4. A wellbore servicing method comprising:

positioning a wellbore servicing system within a wellbore penetrating a subterranean formation, the wellbore servicing system comprising a first wellbore servicing tool incorporated within a tubular string, the tubular string generally defining a tubular string axial flowbore, wherein the internal diameter of the first wellbore servicing tool is not narrower than the internal diameter of the tubular string axial flowbore, the first wellbore servicing tool comprising:

a housing at least partially defining an axial flowbore, the housing comprising one or more ports;

a sliding sleeve recess, the sliding sleeve recess comprising a passageway, a first shoulder, a second shoulder, a third shoulder a fourth shoulder, a first outer surface extending between the first shoulder and the second shoulder, a second outer surface extending between the second shoulder and the third shoulder, an inner surface extending at least partially over the second outer surface and terminating at the fourth shoulder thereby at least partially defining an annular space between the second outer surface and the inner surface, and wherein the housing comprises the sliding sleeve recess;

a sliding sleeve oriented within the sliding sleeve recess, the sliding sleeve comprising a first upper shoulder and a first outer shoulder, the sliding sleeve being slidably positioned within the housing so as to define a fluid reservoir, wherein the sliding sleeve is transitionable from:

a first position in which the sliding sleeve prevents fluid communication via a route of fluid communication from the axial flowbore to an exterior of the housing via the one or more ports and the first upper shoulder is adjacent to the first shoulder, to a second position in which the sliding sleeve allows fluid communication via the route of fluid communication from the axial flowbore to the exterior of the housing via the one or more ports and the first outer shoulder is adjacent to the second shoulder; and a fluid delay system comprising an actuatable valve in fluid communication with the fluid reservoir, wherein the actuatable valve is configured to selectively retain a fluid within the fluid reservoir, and a biasing member applying force to the sliding sleeve in the direction of the second position;

wherein the fluid delay system is configured such that, when the fluid is retained within the fluid reservoir, the sliding sleeve is retained in the first position and, when the fluid is not retained within the fluid reservoir, the sliding sleeve is allowed to transition from the first position to the second position at a controlled rate;

communicating a first wireless signal, received from a signaling member, to a signal receiver of the fluid delay system of the first wellbore servicing tool, wherein receipt of the first wireless signal by the fluid delay system of the first wellbore servicing tool is effective to actuate the actuatable valve of the first wellbore servicing tool; and communicating a wellbore servicing fluid to a first zone of the subterranean formation via the one or more ports of the first wellbore servicing tool.

5. The wellbore servicing method of claim 4, wherein communicating the first wireless signal to the fluid delay system of the first wellbore servicing tool comprises flowing the first signaling member via the axial flowbore of the first wellbore servicing tool.

6. The wellbore servicing method of claim 5, wherein the first signaling member is configured to provide the first wireless signal for receipt by the fluid delay system of the first wellbore servicing tool.

7. The wellbore servicing method of claim 5, wherein the first wireless signal comprises a radio frequency, an RFID signal, a magnetic field, an acoustic signal, a radioactivity signal or combinations thereof.

8. The wellbore servicing method of claim 5, wherein the wellbore servicing system further comprises a second wellbore servicing tool, the second wellbore servicing tool comprising:

a housing at least partially defining an axial flowbore, the housing comprising a one or more ports;

a sliding sleeve, the sliding sleeve being slidably positioned within the housing so as to define a fluid reservoir, wherein the sliding sleeve is transitionable from:

a first position in which the sliding sleeve prevents fluid communication via a route of fluid communication from the axial flowbore to an exterior of the housing via the one or more ports, to a second position in which the sliding allows fluid communication via the route of fluid communication from the axial flowbore to an exterior of the housing via the one or more ports; and a fluid delay system comprising an actuatable valve in fluid communication with the fluid reservoir, wherein the actuatable valve is configured to selectively retain a fluid within the fluid reservoir, wherein the fluid delay system is configured such that, when the fluid is retained within the fluid reservoir, the sliding sleeve is retained in the first position and, when the fluid is not retained within the fluid reservoir, the sliding sleeve is allowed to transition from the first position to the second position at a controlled rate.

9. The wellbore servicing method of claim 8, further comprising:

communicating the first wireless signal to the fluid delay system of the second wellbore servicing tool, wherein receipt of the first wireless signal by the fluid delay system of the second wellbore servicing tool is effective to actuate the actuatable valve of the second wellbore servicing tool; and communicating a wellbore servicing fluid to a second zone of the subterranean formation via the one or more ports of the second wellbore servicing tool.

10. The wellbore servicing method of claim 8, further comprising:

communicating the first wireless signal to the fluid delay system of the second wellbore servicing tool, wherein receipt of the first wireless signal by the fluid delay system of the second wellbore servicing tool is not effective to actuate the actuatable valve of the second wellbore servicing tool.

11. The wellbore servicing method of claim 10, further comprising:

communicating a second wireless signal to the fluid delay system of the second wellbore servicing tool, wherein receipt of the second wireless signal by the fluid delay system of the second wellbore servicing tool is effective to actuate the actuatable valve of the second wellbore servicing tool; and communicating a wellbore servicing fluid to a second zone of the subterranean formation via the one or more ports of the second wellbore servicing tool.

12. The wellbore servicing method of claim 8, wherein the second wellbore servicing tool is incorporated within the tubular string, wherein the internal diameter of the second wellbore servicing tool is not narrower than the internal diameter of the tubular string axial flowbore.

13. A wellbore servicing method comprising:

positioning a wellbore servicing system within a wellbore penetrating a subterranean formation, the wellbore servicing system comprising a first wellbore servicing tool, the first wellbore servicing tool being configured in a first mode and transitionable from the first mode to a second mode and from the second mode to a third mode, the first wellbore servicing tool comprising:

a housing at least partially defining an axial flowbore, the housing comprising one or more ports;

a sliding sleeve recess, the sliding sleeve recess comprising a passageway, a first shoulder, a second shoulder, a third shoulder, a fourth shoulder, a first outer surface extending between the first shoulder and the second shoulder, a second outer surface extending between the second shoulder and the third shoulder, an inner surface extending at least partially over the second outer surface and terminating at the fourth shoulder thereby at least partially defining an annular space between the second outer surface and the inner surface, and wherein the housing comprises the sliding sleeve recess;

a sliding sleeve oriented within the sliding sleeve recess, the sliding sleeve comprising a first upper shoulder and a first outer shoulder, the sliding sleeve being slidably positioned within the housing so as to define a fluid reservoir, wherein a biasing member applies force to the sliding sleeve in the direction of the second position; and a fluid delay system comprising an actuatable valve in fluid communication with the fluid reservoir, wherein the actuatable valve is configured to selectively retain a fluid within the fluid reservoir, wherein the fluid delay system is configured such that, when the fluid is retained within the fluid reservoir, the first wellbore servicing tool is retained in the first mode and the first upper shoulder is adjacent to the first shoulder and when the fluid is not retained within the fluid reservoir, the first wellbore servicing tool is not retained in the first mode, communicating a first wireless signal emitted from a first signaling member to a signal receiver of the fluid delay system of the first wellbore servicing tool, wherein receipt of the first wireless signal by the fluid delay system of the first wellbore servicing tool is effective to actuate the actuatable valve to transition the first wellbore servicing tool from the first mode to the second mode, wherein when the first wellbore servicing tool is retained in the first mode the first upper shoulder is adjacent to the first shoulder and wherein when the first wellbore servicing tool is retained in the second mode the first outer shoulder is adjacent to the second shoulder;

allowing the first wellbore servicing tool to transition from the second mode to the third mode; and after allowing the first wellbore servicing tool to transition from the second mode to the third mode, communicating a wellbore servicing fluid to a first zone of the subterranean formation via the one or more ports of the first wellbore servicing tool.

14. The wellbore servicing method of claim 13, wherein, in the first mode, the fluid delay system is configured to retain the fluid within the fluid reservoir so as to hold the sliding sleeve relative the housing so as to prevent fluid communication via a route of fluid communication from the axial flowbore to an exterior of the housing via the one or more ports, wherein, in the second mode, the fluid delay system is configured to not retain the fluid within the fluid reservoir so as to allow the sliding sleeve to move relative to the housing at a controlled rate, wherein, in the third mode, the sliding sleeve allows fluid communication via the route of fluid communication from the axial flowbore to the exterior of the housing via the one or more ports.

15. The wellbore servicing method of claim 13, wherein communicating the first wireless signal to the fluid delay system of the first wellbore servicing tool comprises flowing the first signaling member via the axial flowbore of the first wellbore servicing tool.

16. The wellbore servicing method of claim 13, wherein the wellbore servicing system further comprises a second wellbore servicing tool, the second wellbore servicing tool being configured in a first mode and transitionable from the first mode to a second mode and from the second mode to a third mode, the second wellbore servicing tool comprising:

a housing at least partially defining an axial flowbore, the housing comprising one or more ports;

a sliding sleeve, the sliding sleeve being slidably positioned within the housing; and a fluid delay system.

17. The wellbore servicing method of claim 16, further comprising:

communicating the first wireless signal to the fluid delay system of the second wellbore servicing tool, wherein receipt of the first wireless signal by the fluid delay system of the second wellbore servicing tool is effective to transition the second wellbore servicing tool from the first mode to the second mode;

allowing the second wellbore servicing tool to transition from the second mode to the third mode; and communicating a wellbore servicing fluid to a second zone of the subterranean formation via the one or more ports of the second wellbore servicing tool.

18. The wellbore servicing method of claim 16, further comprising:

communicating the first wireless signal to the fluid delay system of the second wellbore servicing tool, wherein receipt of the first wireless signal by the fluid delay system of the second wellbore servicing tool is not effective to transition the second wellbore servicing tool from the first mode to the second mode.

19. The wellbore servicing method of claim 18, further comprising:

communicating the second wireless signal to the fluid delay system of the second wellbore servicing tool, wherein receipt of the second wireless signal by the fluid delay system of the second wellbore servicing tool is effective to transition the second wellbore servicing tool from the first mode to the second mode;

allowing the second wellbore servicing tool to transition from the second mode to the third mode; and communicating a wellbore servicing fluid to a second zone of the subterranean formation via the one or more ports of the second wellbore servicing tool.

* * * * *